US005645273A

United States Patent [19]

Nakagawa et al.

[11] Patent Number: 5,645,273

[45] Date of Patent: Jul. 8, 1997

[54] SHEET ORIGINAL SUPPLY APPARATUS AND IMAGE FORMING APPARATUS WITH IT

[75] Inventors: Tomohito Nakagawa, Matsudo; Masakazu Hiroi; Chikara Sato, both of Yokohama; Yoshinori Isobe, Tokyo; Akimaro Yoshida, Yokohama, all of Japan

[73] Assignee: Canon Kabushiki Kaisha, Tokyo, Japan

[21] Appl. No.: 443,557

[22] Filed: May 18, 1995

Related U.S. Application Data

[62] Division of Ser. No. 197,852, Feb. 17, 1994, abandoned.

[30] Foreign Application Priority Data

Feb. 19, 1993 [JP] Japan ..... 5-055095

[51] Int. Cl.[6] ..... B65H 5/00

[52] U.S. Cl. ..... 271/10.1; 271/10.03; 271/10.12; 271/273; 271/275; 271/265.01

[58] Field of Search ..... 271/4.03, 4.09, 271/4.1, 4.08, 10.03, 10.1, 10.11, 10.12, 273, 274, 265.01, 265.02, 275, 270

[56] References Cited

U.S. PATENT DOCUMENTS

| | | | |
|---|---|---|---|
| 4,465,272 | 8/1984 | Kajita et al. | 271/274 |
| 4,896,876 | 1/1990 | Yamada et al. | 271/266 |
| 4,974,827 | 12/1990 | Arai et al. | 271/265 |
| 4,992,827 | 2/1991 | Kobayashi et al. . | |
| 5,018,714 | 5/1991 | Honjo et al. . | |
| 5,072,923 | 12/1991 | Coy | 271/265.01 |
| 5,118,089 | 6/1992 | Yamada et al. | 271/266 |
| 5,119,145 | 6/1992 | Honjo et al. . | |
| 5,132,741 | 7/1992 | Kitajima et al. . | |
| 5,205,548 | 4/1993 | Yamada et al. | 271/270 |
| 5,223,905 | 6/1993 | Yamada et al. | 271/4.03 |
| 5,280,899 | 1/1994 | Kida et al. | 271/10 |

*Primary Examiner*—H. Grant Skaggs
*Attorney, Agent, or Firm*—Fitzpatrick, Cella, Harper & Scinto

[57] ABSTRACT

The present invention provides a sheet original supply apparatus including a conveyor for conveying a sheet original at a reading portion, and a supply device arranged upstream of the conveyor and adapted to send the sheet original to the conveyor, wherein after the sheet original starts to be conveyed by the conveyor and before the sheet original is read at the reading portion, the restraint of the sheet original by the supply device is released.

13 Claims, 23 Drawing Sheets

SHEET ORIGINAL SUPPLY APPARATUS AND IMAGE FORMING APPARATUS WITH IT

This application is a division of application Ser. No. 08/197,852 filed Feb. 17, 1994, now abandoned.

BACKGROUND OF THE INVENTION

1. Field of the Invention

The present invention relates to a sheet original supply apparatus for supplying a sheet original to a predetermined position such as a reading portion of an image forming apparatus such as a copying machine, a laser beam printer and the like and for resting such a sheet original on the predetermined position. Further, the present invention relates to a reading apparatus and an image forming apparatus.

2. Related Background Art

FIG. 26 shows an example of a conventional sheet original supply apparatus. In FIG. 26, a sheet original P is supplied from an original tray 413 to a platen glass 422, where an image on the sheet original is read by an optical system 421 of a copying machine, and then the sheet original is discharged onto a tray 423.

In particular, a separation means 414, 415, supply rollers 416 for effecting regist correction, relay rollers 417, and an image tip end sensor S1 are arranged in order, and, by means of such supply means, the original is passed through the platen 422 from the right, during which the reading-through (in which the image is read while the sheet original is being moved) of the sheet original is performed to form the image.

However, with the above-mentioned conventional arrangement, when the reading-through of the sheet original is being effected while the sheet original is being passed through the platen 422, as a trailing end of the sheet original leaves the relay rollers 417, the load fluctuation acts on the sheet original P, thereby causing discrepancies in the image read at platen 422.

Further, in the above-mentioned conventional technique, the sheet originals P are separated one by one by the separation means 414, 415. When the skew-feed of the sheet original is corrected by abutting the separated sheet original against a nip between the supply rollers 416, since the rear portion of the sheet original is still remaining in the separation means 414, 415 and the separation roller 415 and the separation belt 414 are being rotated in directions shown by the arrows, respectively, as the sheet original is pulled by the supply rollers 416, the sheet original is subjected to a load, with the result that there arises slip between the supply rollers 416 and the original, thereby worsening the regist correction (i.e., causing the error in a sheet feeding amount of the sheet original fed by the supply rollers 416).

Further, a sheet feed path from the supply rollers (regist correction rollers) 416 to the image reading portion 422 becomes long because the relay rollers 417 must be positioned in such a path, with the result that the regist-corrected sheet original may become skewed (out of correct registration) in the path on the way to the image reading portion 422.

SUMMARY OF THE INVENTION

The present invention aims to eliminate the above-mentioned conventional drawbacks, and has an object to provide a sheet original supply apparatus which does not cause the discrepancies in an image read at a reading position.

Another object of the present invention is to provide a sheet original supply apparatus in which skew-feed correction can positively be effected and a sheet original the skew-feed of which was corrected is fed to a reading position as it is.

To achieve the above objects, according to the present invention, there is provided a sheet original supply apparatus including a conveyor for feeding a sheet original at a reading portion, and supply device arranged at an upstream side of the conveyor and adapted to feed the sheet original to the conveyor. Wherein, after the sheet original is conveyed by the conveyor and before a reading operation is effected in the reading portion, a load of the supply device acting on the sheet original is released. More particularly, the supply device includes a pair of rotary members, and the load is released by separating the pair of rotary members from each other.

On the other hand, a distance between a reading start position at the reading portion and the supply means is selected to be greater than a maximum length of an available sheet original.

Preferably, a sensor is arranged between the supply device and the conveyor and a relay supply device, is arranged at an upstream side of the supply device, and a distance between the relay supply device and the sensor is selected to be greater than the maximum length of the available sheet original.

Further, separation supply device may be arranged at an upstream side of the relay supply device, and a distance between the separation supply device and the supply device is selected to be greater than the maximum length of the available sheet original.

According to the present invention, it is possible to prevent the inconvenience that a trailing end of the sheet original is left from the supply device (rollers and the like) while the sheet original is being read. That is to say, the restraint of the trailing end of the sheet original is released before the reading of the sheet original is started. Thus, since the vibration of the sheet original due to the passing-through of the trailing end of the sheet original during the reading operation can be prevented, the discrepancies in the image reading do not occur.

Further, when the skew-feed of the sheet original is corrected, since the restraint of the trailing end of the sheet original by means of the separation supply device is released, the skew-feed correction can be effected smoothly.

In addition, after a tip end of the sheet original is detected by the sensor for providing the reading timing, since the restraint of the sheet original by device of the relay supply means is released and then the sheet original is fed by the supply device, there is no error in a sheet feeding amount and the correct reading timing can be obtained.

DETAILED DESCRIPTION OF THE PREFERRED EMBODIMENTS

The present invention will now be explained in connection with embodiments thereof with reference to the accompanying drawings.

Figure 1:
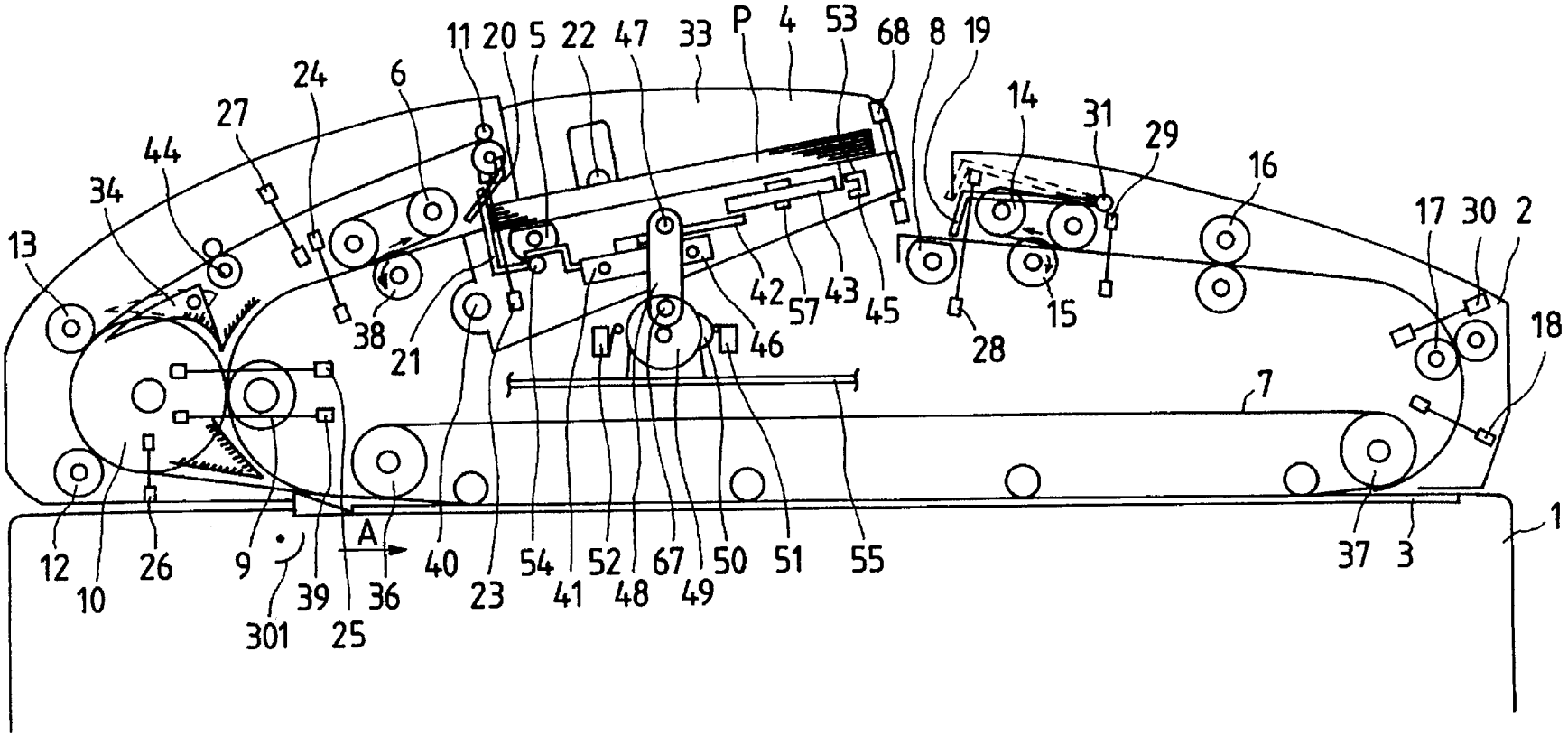
FIG. 1 is a longitudinal sectional front view of a sheet supply apparatus according to a first embodiment of the present invention.

In FIG. 1, an image forming apparatus (electrophotographic copying machine) is constituted by a main body 1 of the image forming apparatus and an RDF (re-circulating original document feeder) 2 as a sheet original supply apparatus. Further, the sheet supply apparatus may be provided with an optical reading system (reading apparatus).

Figure 4:
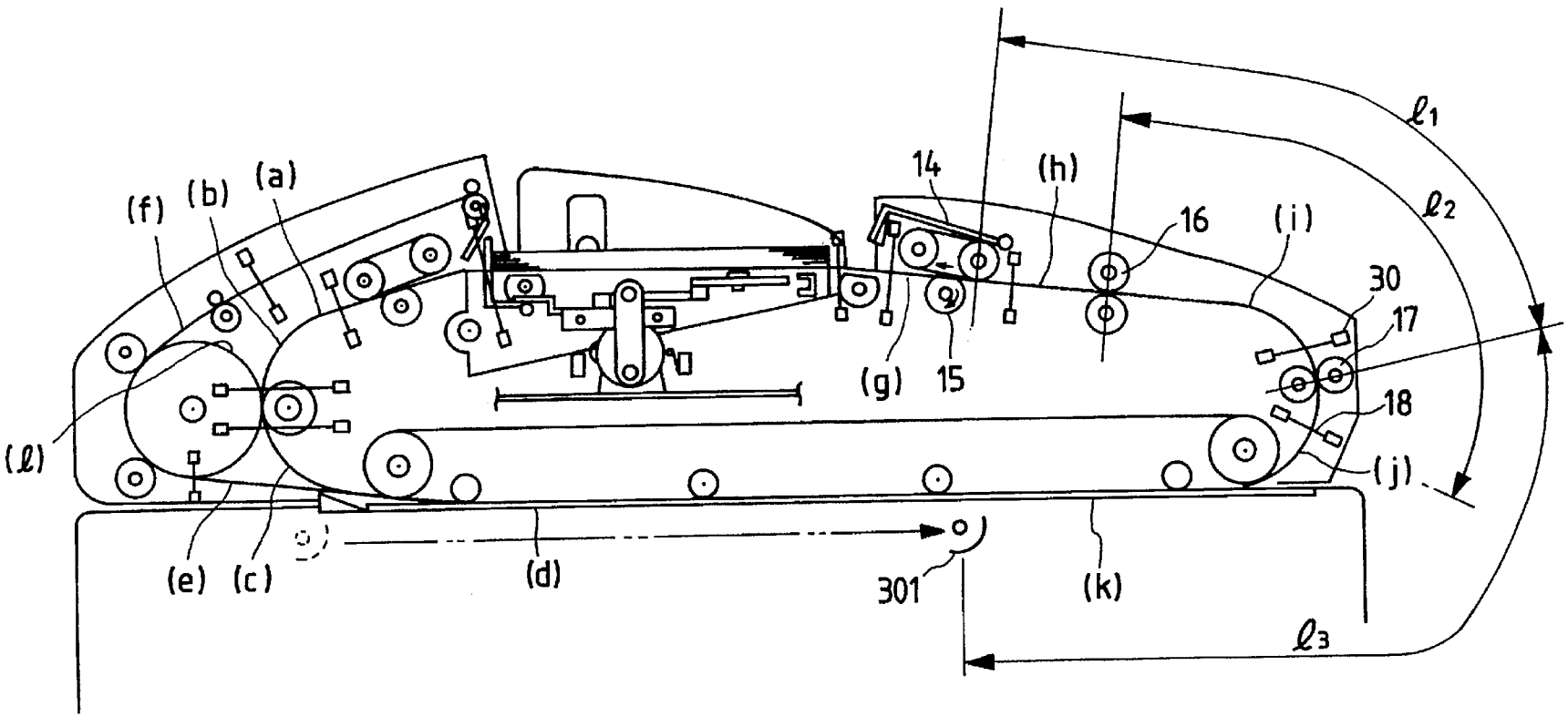
FIG. 4 is a longitudinal sectional front view of the sheet supply apparatus showing a sheet path.

At the left part of the RDF 2, there are arranged a first separation means for conveying a sheet material (sheet original) P to an image reading portion on a platen glass 3 from a left end of the platen glass 3, a first sheet original supply path (a), (b), (c), a second separation means for conveying the sheet original from a right end of the platen glass, and a second sheet original supply path (h), (i), (j) (see FIG. 4).

The main body 1 of the image forming apparatus and the RDF 2 include a control means for switching reading modes between an original reading-stationary mode (in which the sheet original P is conveyed to a predetermined position on the platen 3 and is stopped there, and then an image on the sheet original is read while an optical system 301 of an image reading portion is being shifted in a direction A) and an original reading-through mode (in which the optical system 301 of the image reading portion is fixed at a predetermined position, and the image on the sheet original is read while conveying the sheet original at a predetermined speed), depending upon the size of the sheet original and/or a copying mode. In the original reading-stationary mode, the sheet original P is conveyed by the first separation means and the first supply path (a), (b), (c), thereby forming an image. On the other hand, in the original reading-through mode, the sheet original P is conveyed by the second separation means and the second supply path (h), (i), (j), thereby forming an image.

Next, various elements of the RDF 2 and operations thereof will be explained.

The RDF 2 has an original tray 4 at its upper portion, and a wide belt (convey means or convey rotary member) 7 wound around a drive roller 36 and a turn roller 37 is arranged below the original tray. The wide belt 7 is abutted against the platen 3 of the main body 1 of the copying machine and serves to convey the sheet original P from the original tray 4 to a predetermined position on the platen 3 and to convey the sheet original P from the platen 3 to the original tray 4.

Further, a pair of widthwise direction regulating plates 33 is slidably arranged on the original tray 4 for shifting movement in a widthwise direction of the sheet original P, so that the widthwise direction of the sheet original stack P rested on the original tray 4 is regulated by the regulating plates, thereby ensuring the supplying stability for the sheet original P and the registration of the sheet original when the sheet original is returned on the original tray 4. The widthwise direction regulating plates 33 include a jogging mechanism (which will be described later) for urging each sheet original P discharged on the original tray 4 against the original reference guide 33, thereby further improving the registration of the sheet originals. Further, the original tray 4 can be pivoted around a pivot pin 40 between a position shown in FIG. 1 and a position shown in FIG. 2 by an original tray lifting and lowering mechanism which will be described later.

Figure 6:
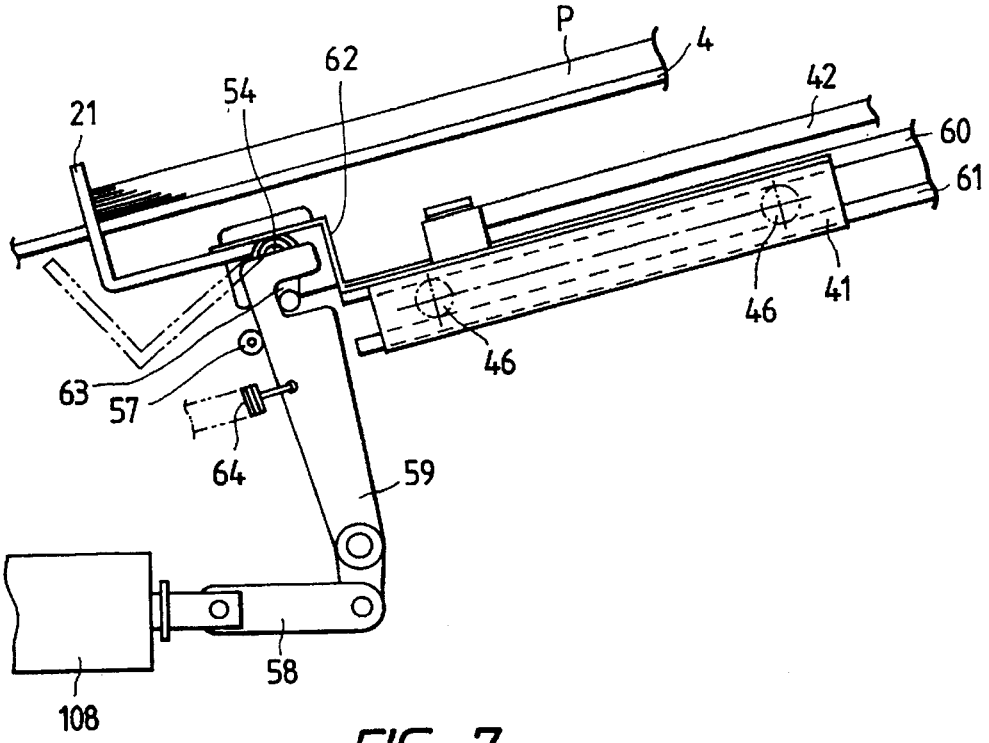
FIG. 6 is a front view of an original tray portion.

Adjacent to the original tray 4, there are arranged a semi-circular sheet supply roller 5 and a 5 stopper 21 shiftable in an up-and-down direction by a stopper solenoid 10 (FIG. 6). The sheet original stack P set on the original tray 4 is regulated by the protruded stopper 21 not to shift in a downstream direction.

When a copying condition is inputted at an operation portion of the copying machine 1 and a start key (not shown) is depressed, the stopper 21 is retracted downwardly to open the original sheet convey path, so that the sheet originals are advanced downstreamly by the action of the sheet supply roller 5. In this case, a partition member 22 connected to a partition member motor 105 (FIG. 5) included in the original reference guide 33 is turned onto the sheet original stack P, thereby dividing non-treated sheet originals from the treated sheet originals.

A first separation portion comprising a convey roller 38 and a separation belt 6 which constitute the separation portion is arranged downstream of the stopper 21, which roller and belt are rotated in directions shown by the arrows, respectively, to separate the sheet originals P fed from the original tray 4 one by one and to convey the separated sheet original downstream. Further, a weight 20 arranged above the stopper 21 is lowered by a weight solenoid 109 (FIG. 5) to pinch the sheet original stack P between the weight and the supply roller 5, thereby enhancing the supplying force of the supply roller 5 when the number of the sheet originals P on the original tray 4 is decreased so that the sheet original P cannot be fed only by the supplying force of the supply roller 5.

The original supply path (a), (b), (c) extends from the separation portion 6, 38 to the platen 3 (FIG. 4), which original supply path is curved to be connected to the convey path on the platen 3 to direct the sheet original onto the platen 3. Further, inlet sensors 23*a*, 23*b* which are optical sensors of permeable type for detecting the presence/absence of the sheet original P on the original tray 4 are arranged in the proximity of the sheet supply roller 5.

A large roller 10 is arranged at the left portion of the body of the RDF 2, and an original discharge path (e), (f) extending from the platen 3 to the original tray 4 through the periphery of the large roller 10 is provided (FIG. 4). Further, an original reverse rotation path (l) (FIG. 4) for reversely rotating or inverting the sheet original is branched from the original discharge path (e), (f) above the large roller 10, and a downstream end of the reverse rotation path (l) is jointed to the original supply path (b). Relay rollers 44 and discharge rollers 11 are arranged at a downstream side of the original discharge path (f) so that the sheet original P conveyed through the original discharge path (e), (f) is returned onto the sheet original stack P on the original tray 4. The wide belt 7 disposed on the platen 3 serves to convey the sheet original P to the predetermined position on the platen 3 and to stop it there, and to discharge the sheet original from the platen 3 after the image on the sheet original is read.

A supply roller 9 is disposed at a junction between the original supply path (a), (b), (c) and the original reverse rotation path (l), which supply roller 9 serves to form a loop in the sheet original to correct the skew-feed of the sheet original P. Reverse rotation sensors 25*a*, 25*b* which are optical sensors of permeable type for detecting leading and trailing ends of the sheet original P are arranged in the proximity of the downstream side of the supply roller 9 so that the sheet original P passed through either the original supply path (a), (b), (c) or the original reverse rotation path (l) can be detected. Further, regist sensors 39*a*, 39*b* which are optical sensors of permeable type for detecting the trailing end of the sheet original P are arranged at a downstream side of the supply roller 9.

Reverse rotation sensors 26*a*, 26*b* which are optical sensors of permeable type for detecting the sheet original P discharged from the platen 3 are arranged below the large roller 10 in the original discharge path (e), (f), and discharge sensors 27*a*, 27*b* which are optical sensors of permeable type for detecting the passage of the sheet original P passed through the original discharge path (f) and to be discharged onto the original tray 4 are arranged in the original discharge path (f) between the large roller 10 and the discharge rollers 11. A reverse rotation flapper 34 for switching a path is disposed in a portion branched from the original discharge path (e), (f) to the original reverse rotation path (l), which flapper can be pivoted between a position shown by the solid line in FIG. 5 and a position shown by the dot and chain line by ON/OFF of a reverse rotation flapper solenoid 110 (FIG. 5) to switch the path.

Further, the second original separation means for conveying the sheet original to the image reading portion on the platen 3 from the right of the platen 3, and the second original supply path (h), (i), (j) (FIG. 4) are arranged at the right portion of the body of the RDF 2.

Figure 2:
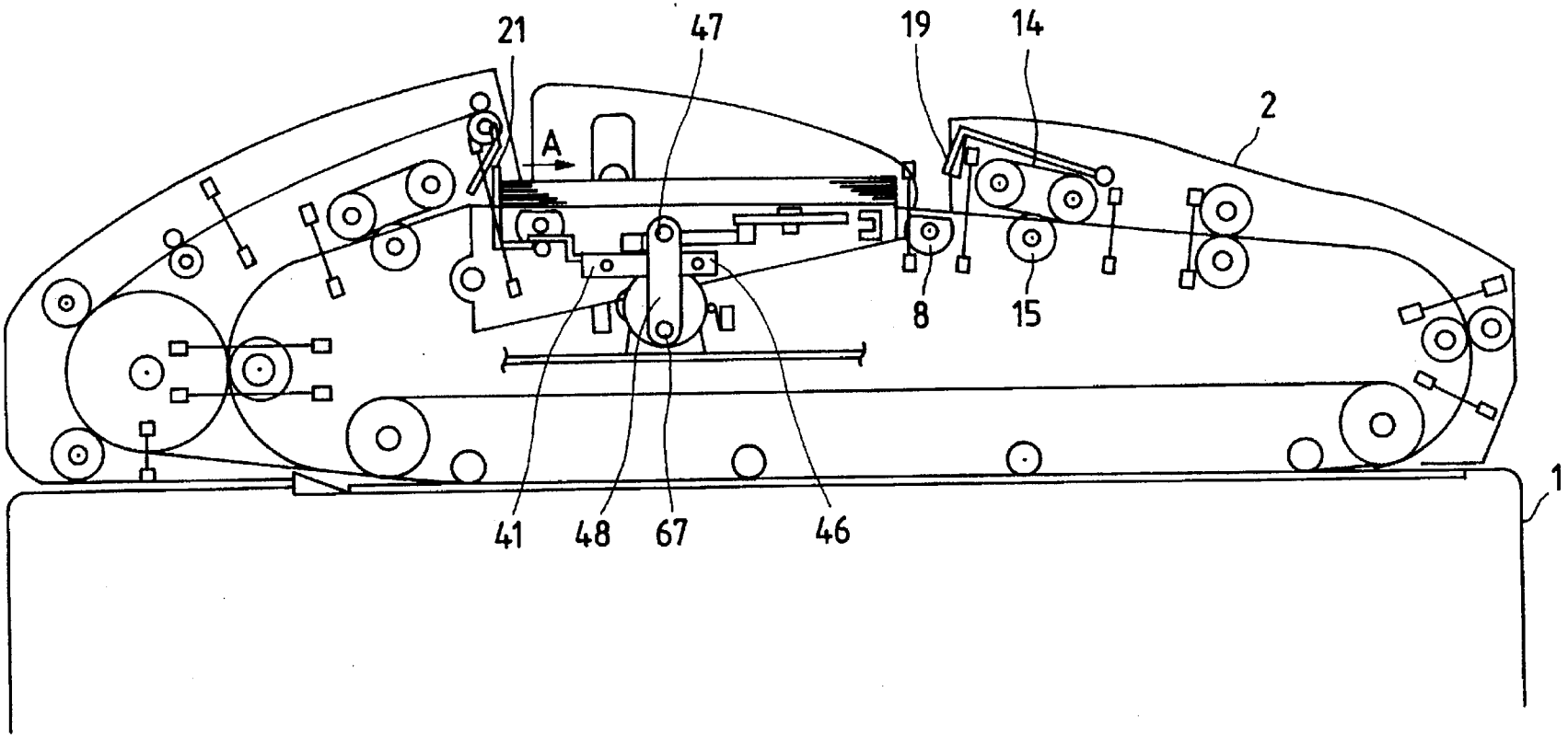
FIGS. 2 and 3 are longitudinal sectional front views of the sheet supply apparatus in a condition that a sheet bundle convey is effected.

The original tray 4 is shifted between the upper limit position shown in FIG. 1 and the lower limit position shown in FIG. 2 in response to the upper and lower pivotal movement of the original tray 4 which will be described later. As shown in FIG. 2, when the original tray 4 is in the lower limit position, a second semi-circular sheet supply roller 8, and a convey roller 15 and a separation belt 14 which constitute a second separation portion are arranged adjacent to the original tray 4. These elements 8, 15, 14 are rotated in directions shown by the arrows to separate the sheet originals P fed from the original tray 4 one by one and to convey the separated sheet original downstream.

In FIG. 6, the stopper 21 and a short arm 63 integrally formed with the stopper are pivotable around a pivot pin 54, and a pin of the short arm 63 is engaged by a recessed portion of an operation member 59 so that, when the operation member 59 is rotated in a clockwise direction, the stopper 21 is shifted to a position shown by the dot and chain line. The operation member 59 an intermediate portion of which is pivotally mounted on a pivot pin is biased toward a counterclockwise direction by a tension spring 64 and the rotation of the operation member 59 is regulated by a stopper 57. A lower end of the operation member 59 is connected to the stopper solenoid 108 via a connecting member 58.

Figure 7:
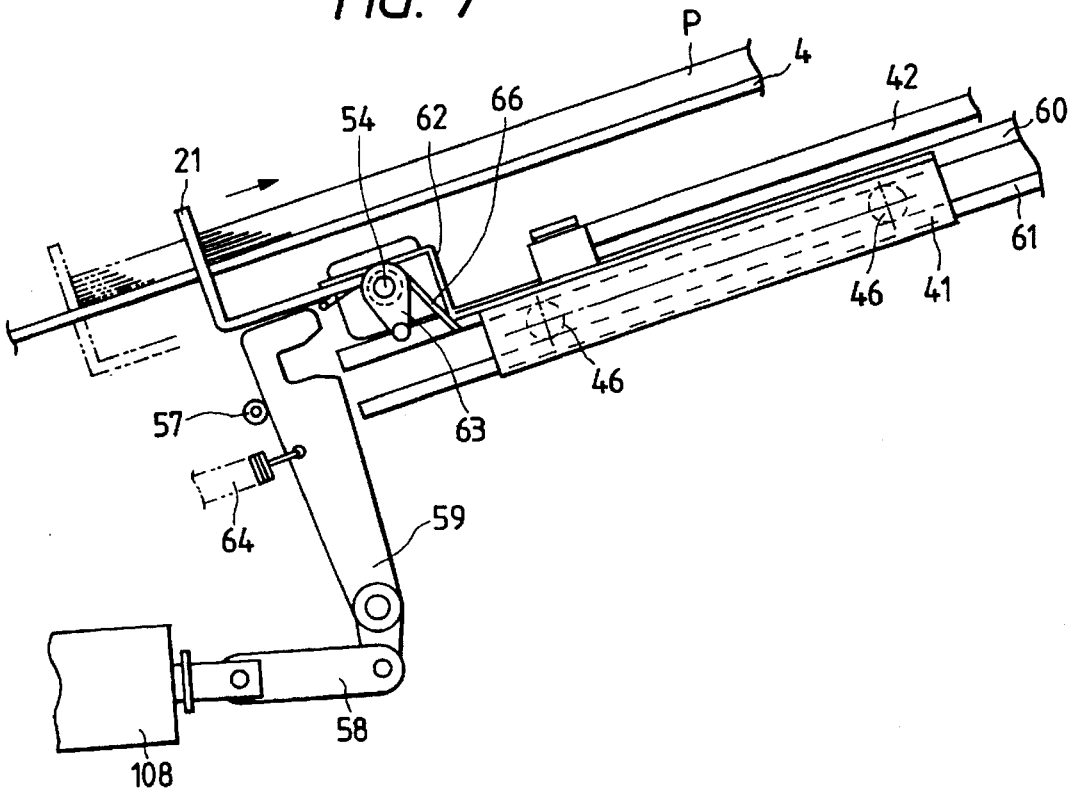
FIG. 7 is a front view of the original tray portion showing an operation thereof.

The original tray 4 is shifted to the upper limit position or the lower limit position depending upon the size of original rested on the original tray and/or the input condition of the image forming apparatus. When the tray 4 reaches the lower limit position, the sheet original stack P rested on the original tray 4 is bundle-conveyed toward the second separation means 14, 15 by a predetermined distance by the above-mentioned stopper 21 of the tray 4. A stopper slider 41 is shifted along guides 60, 61 (FIG. 6) formed on the tray 4 via rollers 46 by a rotation of an eccentric cam 43 connected to a link 42 (see FIGS. 7 and 8).

Figure 8A:
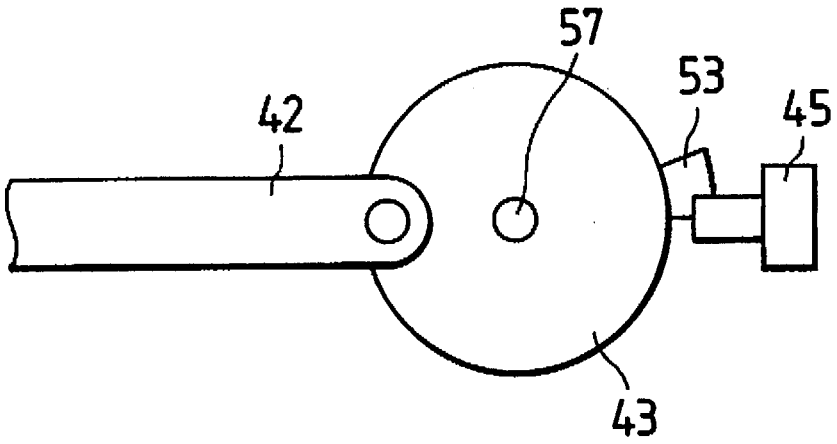
FIGS. 8A and 8B are plan views of a bundle convey drive portion.
Figure 8B:
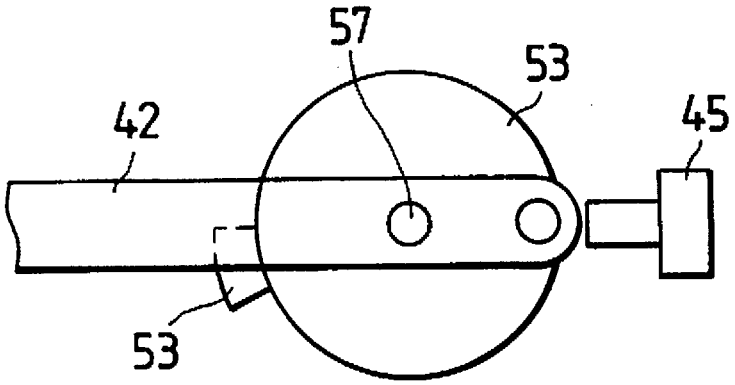

A flag 53 is formed on the eccentric cam 43 mounted on a shaft 57, and a sensor 45 of permeable type is associated with the cam to detect the flag for determining a home position (FIGS. 6 and 8). When the original tray 4 reaches the lower limit position, a sheet original stopper 19 is pivoted upwardly around a pivot pin 31 by the original stopper solenoid 111 (FIG. 5), so that the sheet original stack P bundle-conveyed by the bundle convey means can be received. The bundle-conveyed sheet original stack P is always conveyed to a position (FIG. 3) where the presence of the sheet original stack is detected by optical sensors 28*a*, 28*b* of permeable type for detecting the presence/absence of the sheet original arranged at an upstream side of the proximity of the second separation means.

Figure 3:
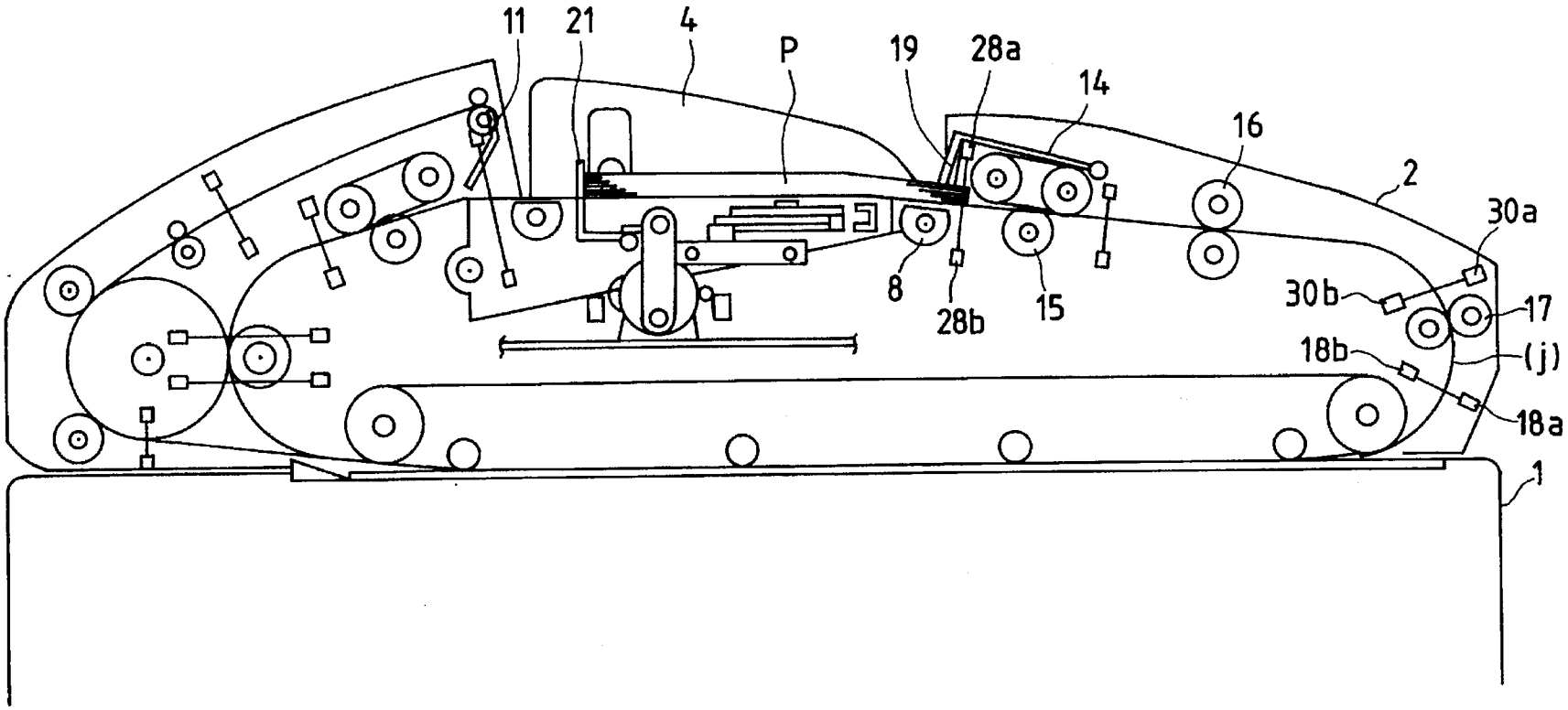

When the bundle-convey is finished, the sheet original stopper 19 is rested on the sheet original stack P. As shown in FIG. 3, at a downstream side of the second separation means 14, 15, there are arranged relay rollers (sheet supply means) 16, and second supply rollers (rotary members, regist convey means or skew-feed correction rollers) 17 are arranged at a downstream side of the relay rollers 16. The second supply rollers 17 serve to form a loop in the sheet original which has reached the rollers 17, thereby correcting the skew-feed of the sheet original P. Second sheet supply sensors 30*a*, 30*b* which are optical sensors of permeable type for detecting the leading and trailing ends of the sheet original P are arranged at an upstream side of the proximity of the second supply rollers 17. Optical sensors (sheet material detection means) 18*a*, 18*b* of permeable type for detecting a tip end position of the sheet original P are arranged in the second sheet supply path (j). The timing control for the sheet material on which the image is formed in the image forming apparatus is effected by these image tip end sensors 18*a*, 18*b*.

Incidentally, when the lowermost sheet original is conveyed up to the separation portion by the second convey roller 8, the following actions occur:

(1) When the number of sets of copies is set to be 1 (part) by an input key in the image forming apparatus, as shown in FIG. 3, the sheet original stopper 19 remains on the sheet original stack P so that the sheet original discharged by the discharge rollers 11 is prevented from entering into the second separation portion.

Figure 9:
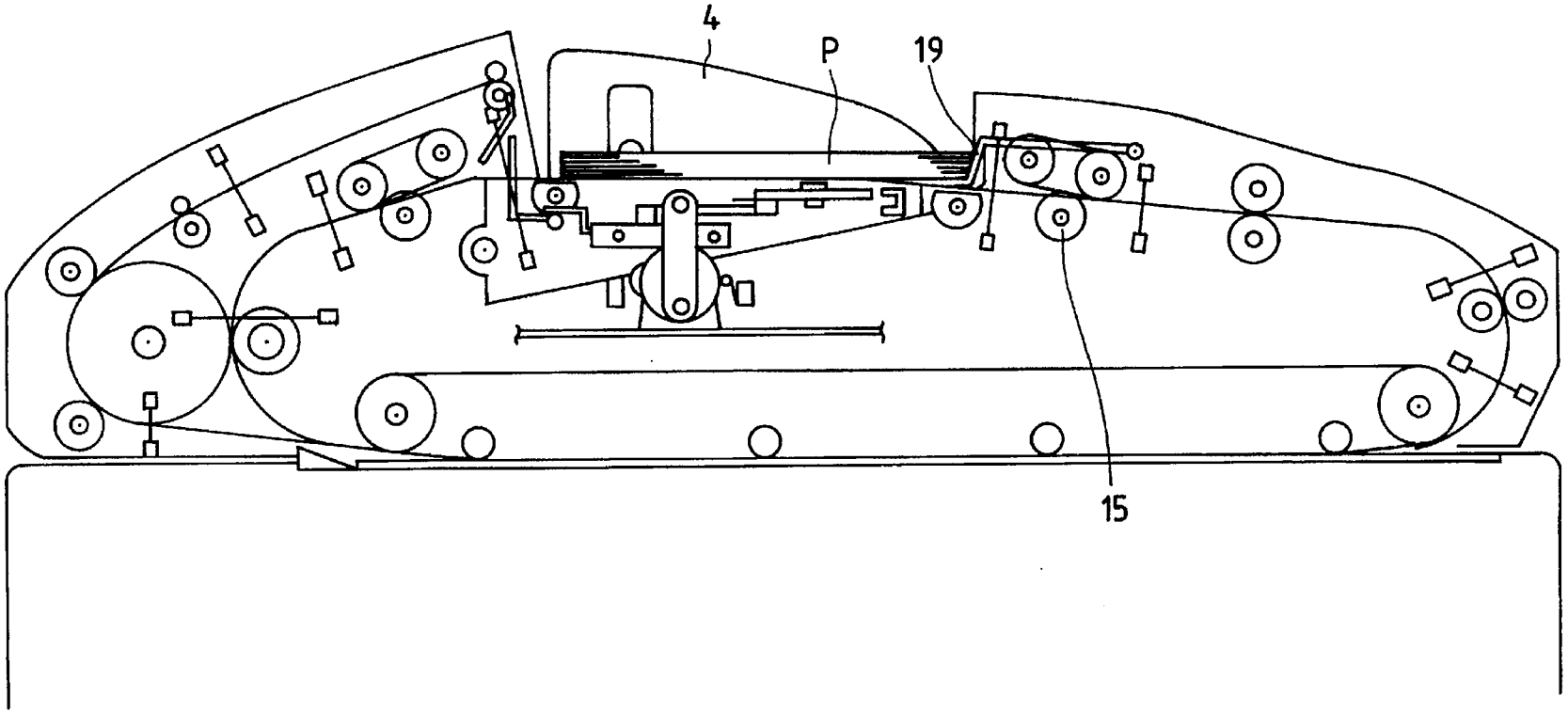
FIG. 9 is a sectional front view of the sheet supply apparatus showing an operation thereof.
Figure 16:
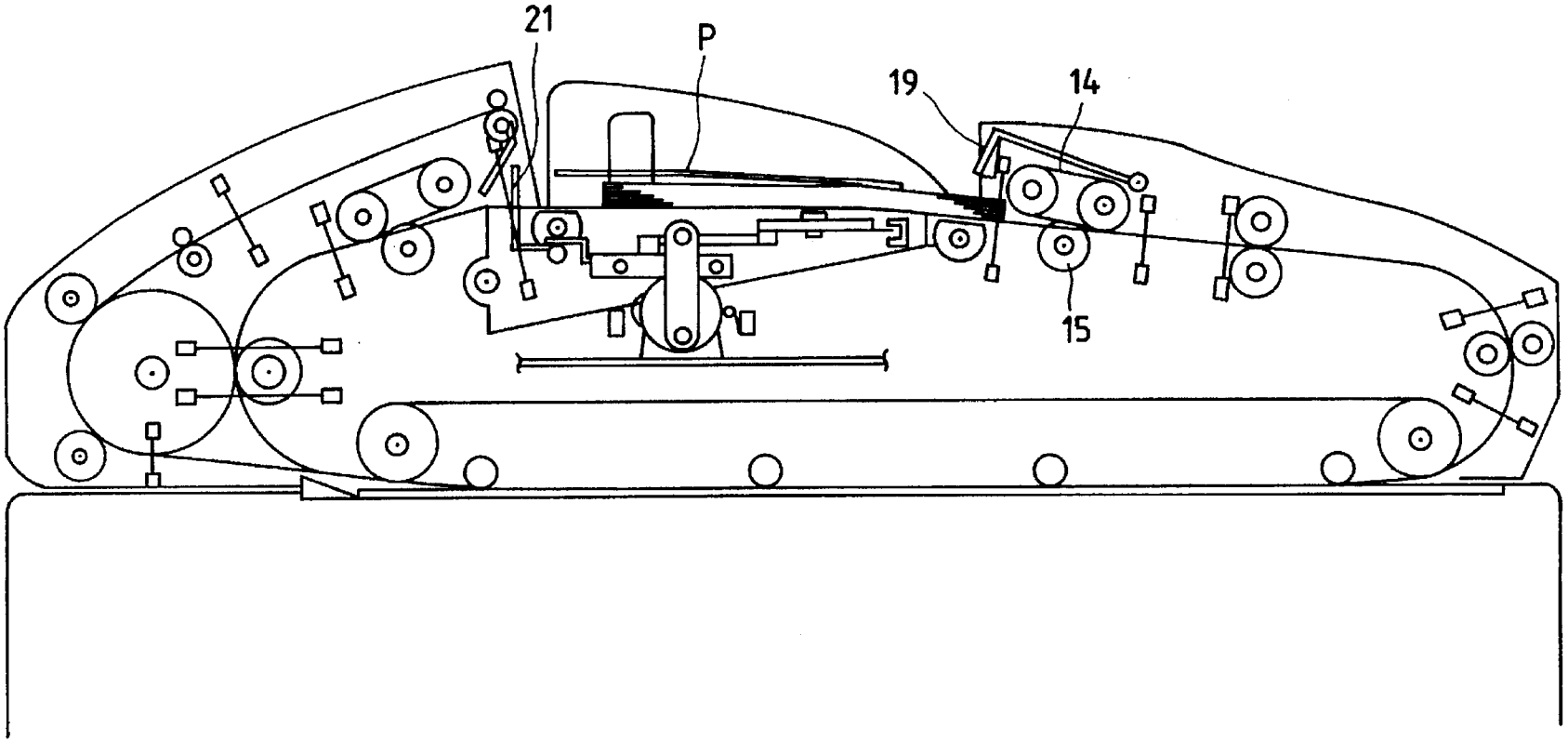

(2) When the number of sets of copies is set to be n (parts) by the input key in the image forming apparatus (i.e., when a set of sheet originals are circulated by n times), as shown in FIGS. 16 and 17, the Sheet original stopper 19 is retarded upwardly until the set of sheet originals are circulated by (n−1) times, and, when the first sheet original in the n-th circulation is re-rested on the original tray 4, the sheet original stopper 19 is rested on the sheet original stack P to prevent the first sheet original from entering into the second separation portion. When the n-th circulation is finished, as shown in FIG. 9, the tip end of the sheet original stack P is regulated by the sheet original stopper 19. Thereafter, the original tray 4 is shifted upwardly to stop at the upper limit position. Similarly, when the number of sets is 1 (part), the arrangement as shown in FIG. 9 is adopted.

Further, as shown in FIG. 4, a distance $l_1$ between the separation portion 14, 15 and the supply rollers 17 along the second original convey path (h), (i), a distance $l_2$ between the relay rollers 16 and the image tip end sensor 18 along the convey path (i), (j) and a distance $l_3$ between the supply roller 17 and the fixed position of the optical system 301 of the image forming apparatus 1 in the reading-through mode along the convey path (j), (k) are selected to be greater than the size (for example, LTR 216 mm) of the sheet original having the maximum length among the sheet originals which can be conveyed in the second original convey path. Incidentally, the separation portion 14, 15 is also referred to as reversible rotary members (roller or belt), or feed roller and return roller, or separation supply means.

That is to say, the separation portion 14, 15, supply rollers 17, relay rollers 16 and the image tip end sensor 18 are arranged to satisfy a relation "distances $l_1$, $l_2$, $l_3$>216 mm" and such positional relation is referred to as a convey load avoiding means (construction). By providing the convey load avoiding means in the sheet supply apparatus 2, the aforementioned conventional drawbacks can be eliminated.

Incidentally, in case of the sheet originals having a size greater than the LTR (letter) size, the RDF 2 of the present invention supplies the sheet original from the first sheet supply path.

FIGS. 10 to 14 show a condition that the sheet originals P on the tray 4 are supplied through the original supply path (second original supply path) in the reading-through mode in detail.

Figure 10:
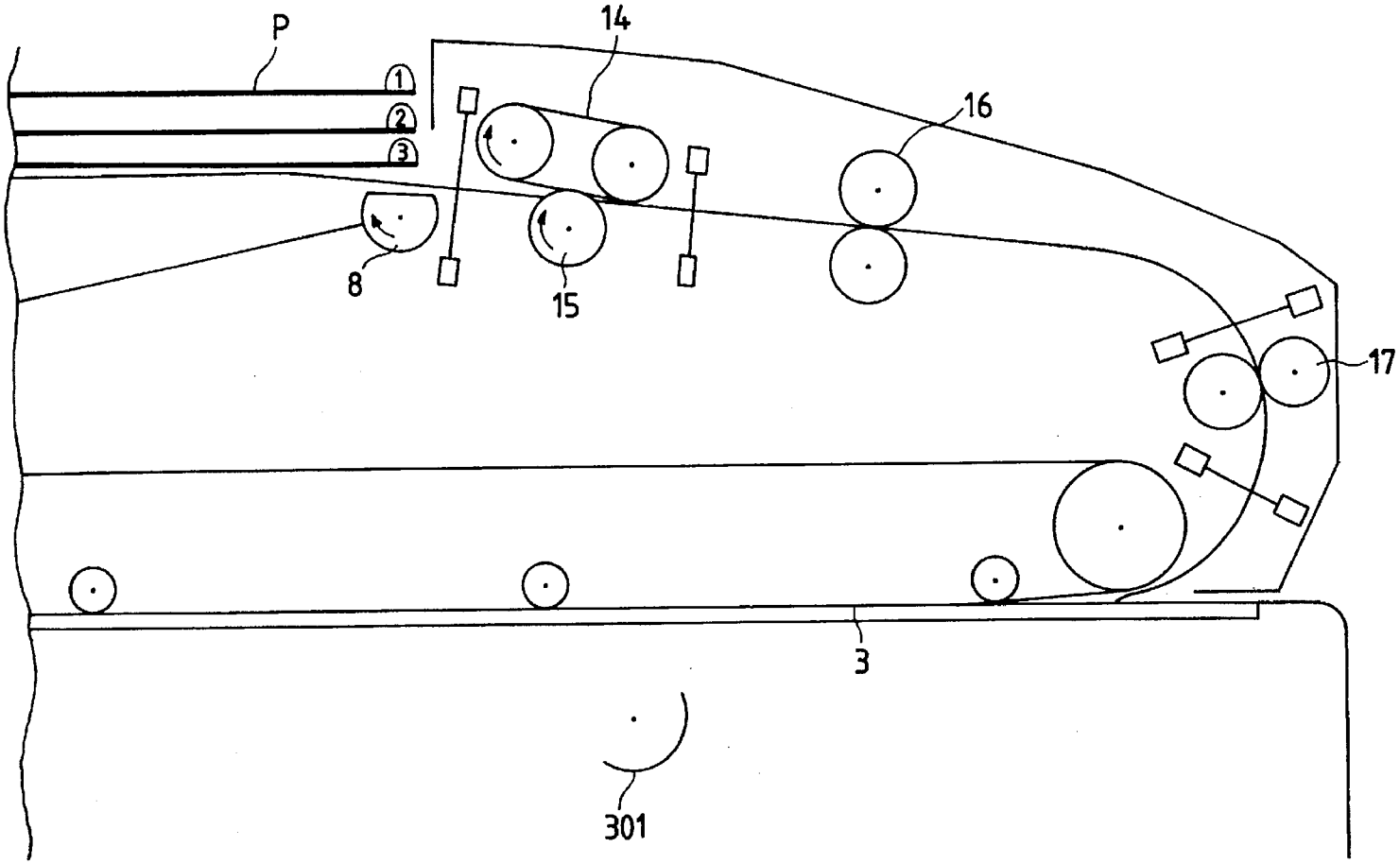
FIGS. 10 to 14 are sectional front views for explaining a sheet supplying operation of the sheet supply apparatus.

In FIG. 10, when the start key (not shown) of the image forming apparatus 1 is depressed, the tray 4 is shifted to the lower limit position, the sheet original stack P is bundle-conveyed by the stopper 21 of the tray 4 toward the second separation means 14, 15 by the predetermined distance, the sheet original stopper 19 (not shown in FIGS. 10 to 14) is rested on the sheet original stack P on the supply roller 8, and the supply roller 8 and the separation means 14, 15 are rotated in the directions shown by the arrows, thereby separating the sheet originals P one by one and conveying the separated sheet original.

Figure 11:
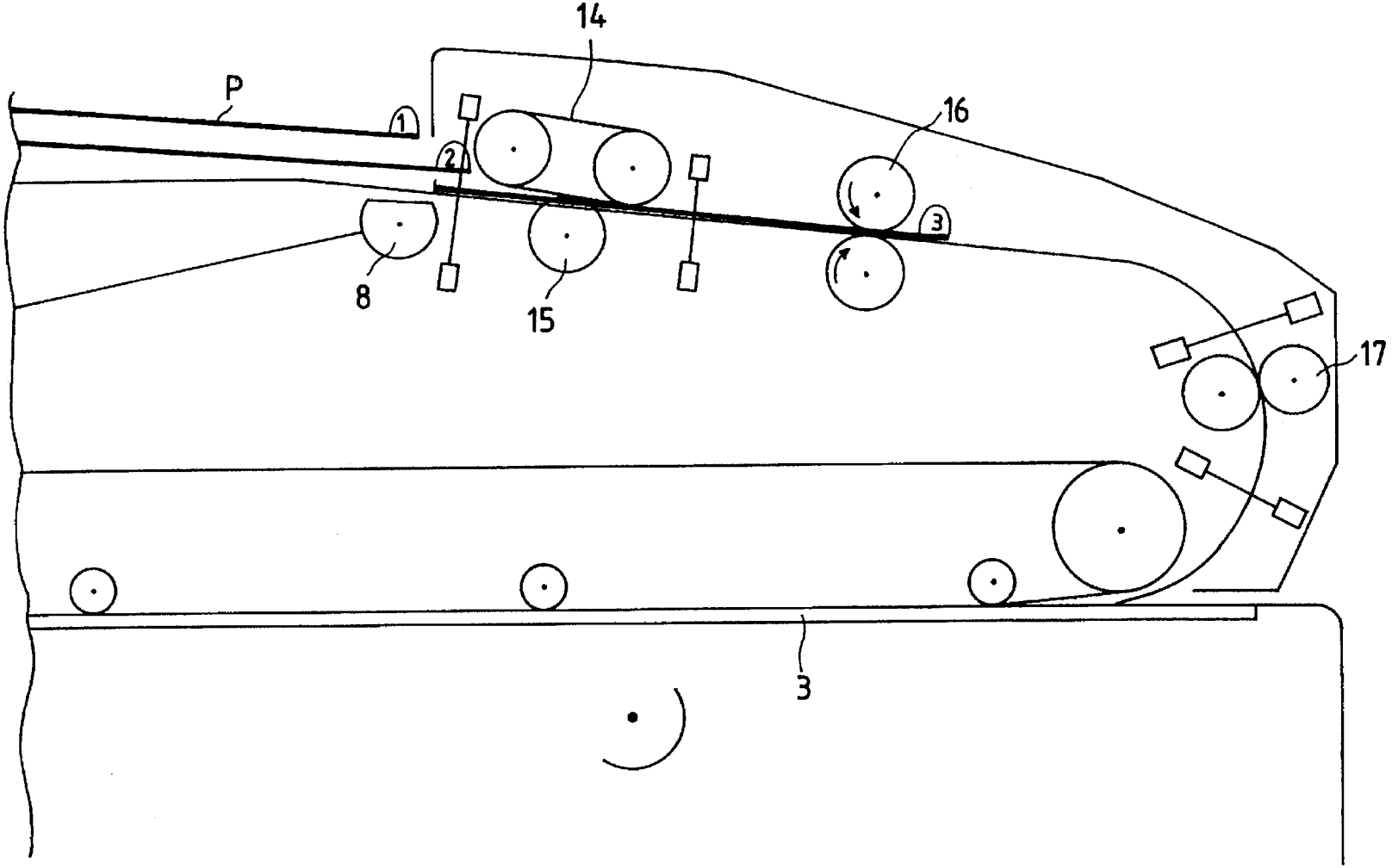

FIG. 11 shows a condition that the sheet original P is being conveyed by the relay rollers 16. Incidentally, in this case, in order to prevent the double feed of the originals, the separation portion 14 is not driven. As a result, the separation portion applies the load to the sheet original which is being conveyed by the relay rollers 16.

Figure 12:
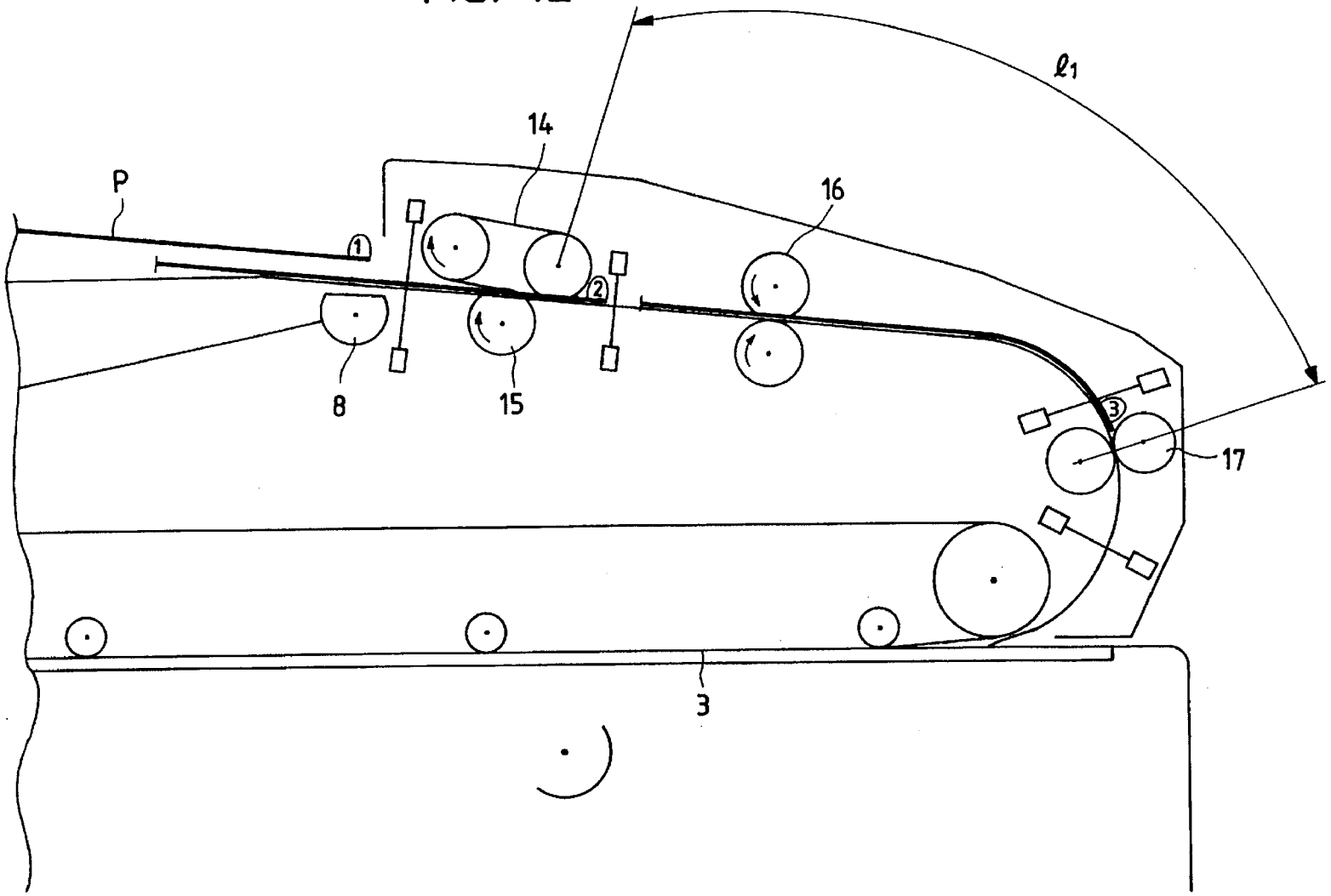

FIG. 12 shows a condition that the tip end of the preceding sheet original (first sheet original) P was reached to the supply rollers 17 (now stopped) so that the tip end of the sheet original P is abutted against the nip between the supply rollers 17 while forming a predetermined loop (to perform the registration of the tip end of the sheet original P). As mentioned above, since distance $l_1$ between the second separation portion 14, 15 and the supply rollers 17 is selected to be greater than the size of the sheet original having the maximum length among the sheet originals which can be conveyed through the second supply path, when the tip end of the sheet original P is abutted against the nip between the sheet supply rollers 17, since the trailing end of the sheet original P has already been left from the second separation portion 14, 15, the above-mentioned load does not act on the sheet original, and, thus, the regist correction (skew-feed correction) can surely be effected. Thereafter, while the sheet original is being conveyed, the load of the separation portion does not act on the sheet original.

Figure 13:
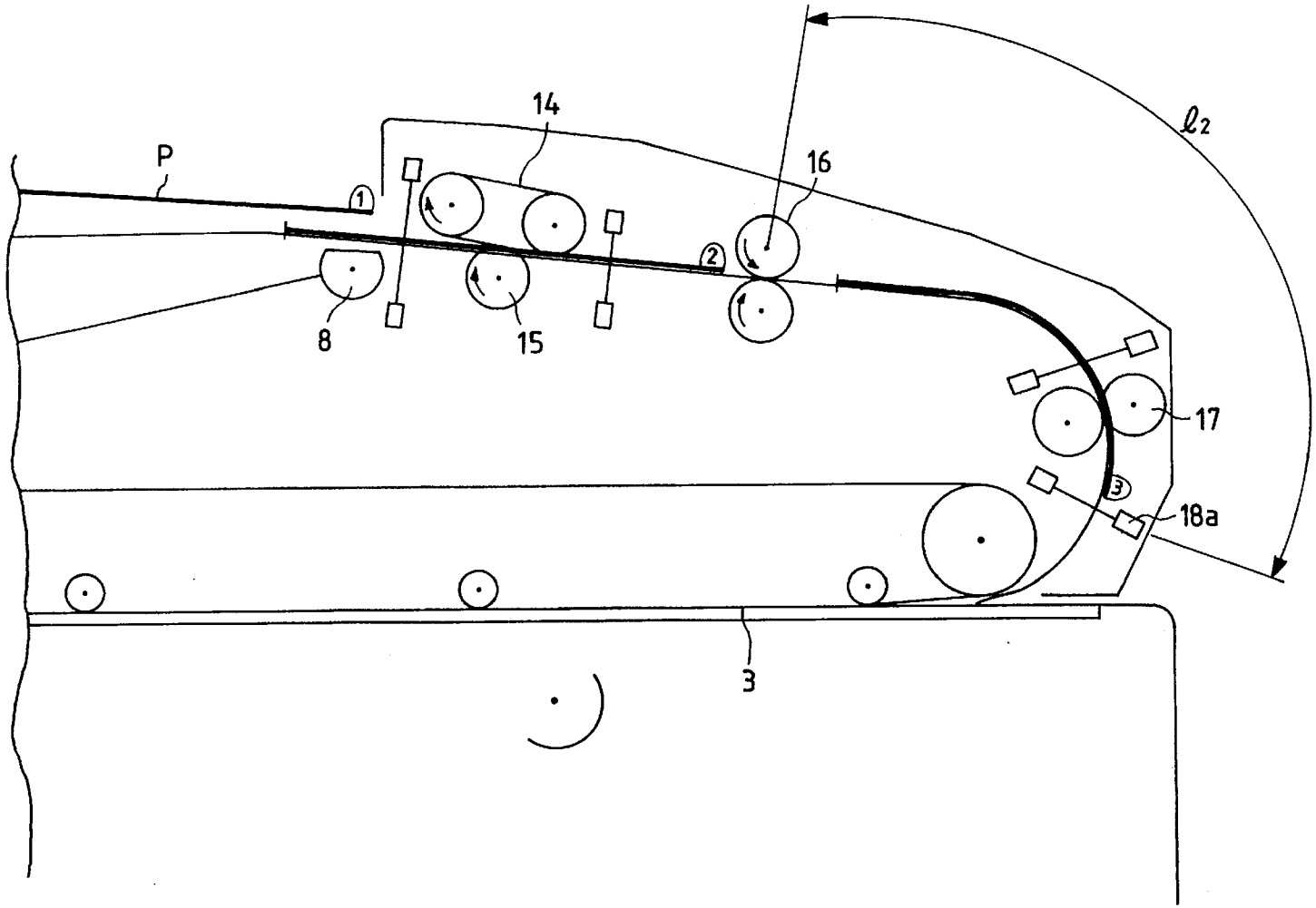

Next, FIG. 13 shows a condition that the trailing end of the registrated preceding sheet original P was passed through the relay rollers 16 and the tip end of the sheet original P is conveyed by the supply rollers 17 by a predetermined amount not to reach the image tip end sensor 18 and the sheet original is waiting there. Such waiting continues while the preceding sheet original is being treated. By holding the sheet original in front of the platen, the high speed treatment can be achieved. In FIG. 12, thereafter, the supply rollers 17 are driven by a motor 104 at the same speed as that of the relay rollers 16 in synchronism with the latter by engaging or applying a clutch 115 (the drive portion will be described fully in connection with FIG. 5).

Further, since the distance $l_2$ between the relay rollers 16 and the image tip end sensor 18 is selected as mentioned above, even when the trailing end of the sheet original P leaves the relay rollers 16, the tip end of the sheet original does not yet reach the image tip end sensor 18. That is to say, since the timing of the image tip end in the reading-through mode is selected on the basis of a time when the tip end of the sheet original reaches the image tip end sensor 18, the distance $l_2$ is required to prevent the load of the relay rollers 16 from exerting force on the sheet original P and to convey the sheet original stably and correctly (without any slip) only by the supply rollers 17. Incidentally, when the sheet original is stopped in FIG. 13, the trailing end of the sheet original may be pinched between the relay rollers 16 and the trailing end of the sheet original may be left from the relay rollers 16 before the tip end of the sheet original reaches the image tip end sensor 18. However, the condition shown in FIG. 13 is more preferable in consideration of the convey safety. That is to say, the tip end of the sheet original may be stopped in front of the image tip end sensor 18.

Figure 14:
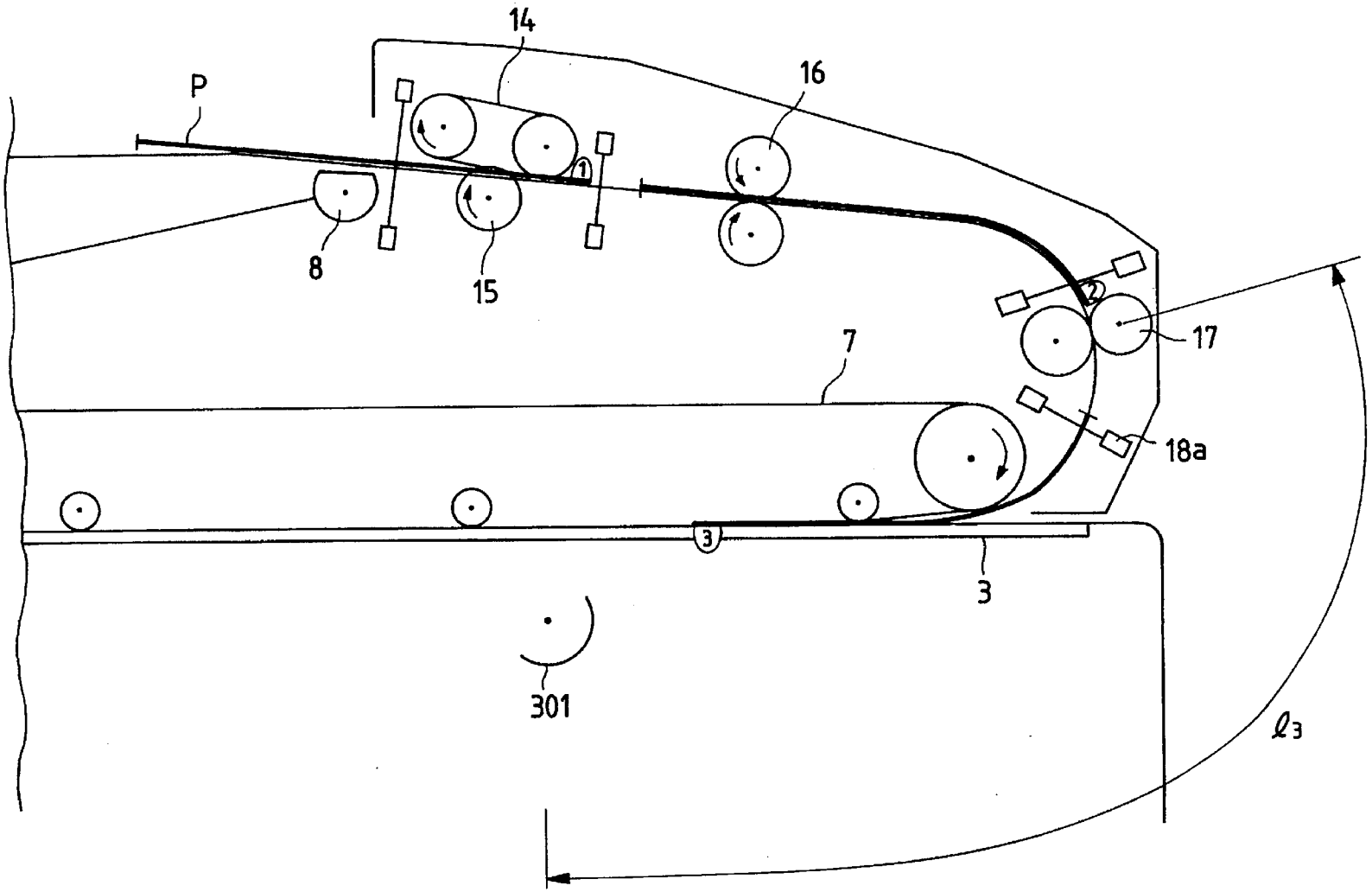

FIG. 14 shows a condition that the sheet original is re-conveyed from the stable waiting condition (left from the nip between the rollers 16) and is being conveyed to the fixed optical system 301 along the platen 3. By driving the supply rollers 17 by a belt motor 102 via the disengaged clutch 115 and an engaged clutch 116 (FIG. 5), since the transferring of the sheet original P from the supply rollers 17 to the belt 7 is stabilized, it is possible to prevent the slip and slack in the sheet original which would be generated if the transferring speed is changed while the sheet original is being conveyed to the optical system 301 for performing the reading-through from the condition that the tip end of the sheet original reaches the image tip end sensor 18, and, thus, to correctly register the tip end of the sheet original in the reading-through mode. Further, since the clutches are not switched during the image reading operation, the change in speed can be avoided.

Further, since the distance $l_3$ between the supply rollers 17 and the optical system 301 in the reading-through mode is selected as mentioned above, the reading of the image is started after the trailing end of the sheet original P leaves the supply rollers 17, with the result that, in the reading-through mode, it is possible to prevent the discrepancies in the image due to the load fluctuation generated when the trailing end of the sheet original leaves the supply rollers 17.

When the image formation in the reading-through mode is finished, the sheet original is conveyed through the discharge path starting from the left end of the platen and is discharged onto the sheet original stack P on the tray 4.

Alteration of the First Embodiment

When the rollers 17 are shiftable in an up-and-down direction as similar to rollers 517 (FIG. 23) which will be described later, the distance $l_3$ may be shorter than the maximum size of the sheet original. That is to say, when the tip end of the sheet original reaches the belt 7, the rollers 17 may be separated from each other.

Next, the drive system of the RDF 2 of the present invention will be explained with reference to FIG. 5 which shows a drive system including motors and solenoids for driving the rollers and flappers.

Figure 5:
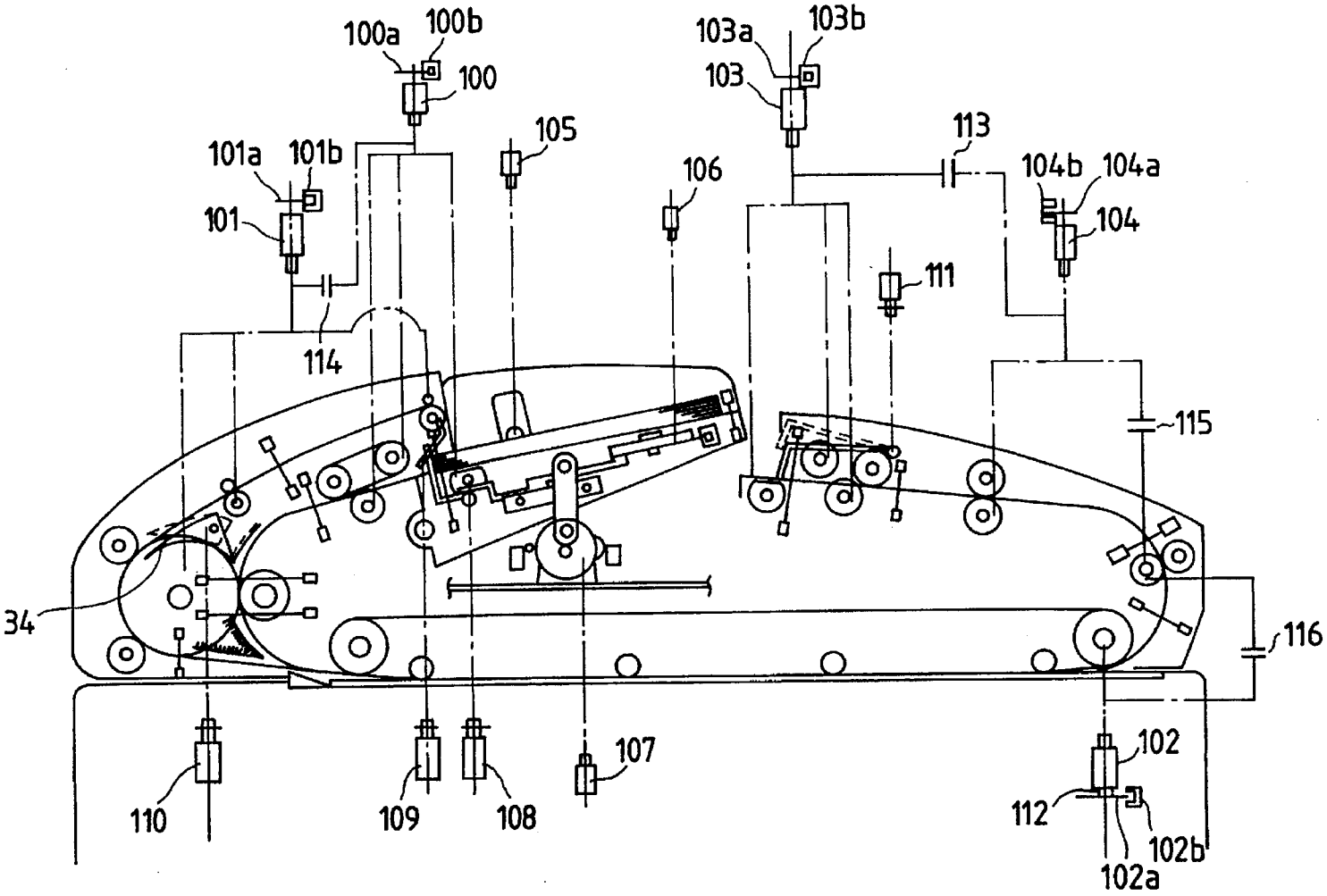
FIG. 5 is a constructional view showing a drive system of the sheet supply apparatus.

In FIG. 5, a first separation motor 100 serves to drive the convey roller 38 and separation belt 6 (separation portion) in the directions shown by the arrows in FIG. 1. A belt motor 102 serves to drive the drive roller 37 for driving the wide belt 7 and the supply rollers 17, and the rotation of the drive roller 37 is transmitted to the turn roller 36 via the wide belt 7. Further, a brake 112 is provided on a motor shaft of the belt motor 102 to ensure the stop position of the wide belt 7.

A reverse rotation motor 101 serves to drive the large roller 10 and the discharge rollers 11. A second separation roller 103 serves to drive the convey roller 15 and the separation belt 14 in directions shown by the arrows in FIG. 1. A motor 104 serves to drive the second supply rollers 17 and the relay rollers 16. A third clutch 115 and a fourth clutch 16 are provided so that the second supply rollers 17 can be driven by either the motor 104 or the belt motor 102.

Clock disks 100*a*, 101*a*, 102*a*, 103*a*, 104*a* each having a plurality of slits are mounted on respective motor shafts of the above-mentioned motors, and clock sensors 100*b*, 101*b*, 102*b*, 103*b*, 104*b* which are optical sensors of permeable type are associated with the corresponding clock disks to generate pulses by detecting the slits. By clock counting the rotations of the motors by the clock sensors 100*b*, 101*b*, 102*b*, 103*b*, 104*b*, rotational amounts of the rollers can be measured to detect the shifting amount of the sheet original P.

When a reverse rotation flapper solenoid 110 for pivoting the reverse rotation flapper 34 is turned OFF, the reverse rotation flapper 34 is in a position shown by the solid line so that the sheet original P passed through the original discharge path (e), (f) can be discharged onto the original tray 4. On the other hand, when the solenoid 110 is turned ON, the sheet original P passed through the original discharge path (e), (f) is directed to the original reverse rotation path (l).

A stopper solenoid 108 serves to drive the stopper 21 in the up-and-down direction. When the solenoid 108 is turned OFF, the stopper 21 is in a position shown in FIG. 1 to prevent the sheet original stack P on the original tray 4 from shifting downstreamly. When the solenoid 108 is turned ON, the stopper 21 is retracted downwardly to open the convey path for the sheet original P (FIG. 6).

A weight solenoid 109 serves to shift the weight 20 in the up-and-down direction. When the solenoid 109 is turned OFF, the weight 20 is in a position shown in FIG. 1; whereas, when the solenoid 109 is turned ON, the weight 20 is shifted downwardly to urge the sheet original stack P against the sheet supply roller 5, thereby enhancing the conveying force of the sheet supply roller 5. An original stopper solenoid 111 serves to pivot the original stopper 19 in the up-and-down direction. When the solenoid 111 is turned OFF, the original stopper 19 is in a position shown by the solid line; whereas, when the solenoid 111 is turned ON, the original stopper is shifted upwardly to a position shown by the broken line.

Next, the pivotal movement of the original tray 4 will be explained.

A tray rock motor 107 is attached to a support member 55 (FIG. 1) and a cam member 49 integral with a motor shaft of this motor is connected to a tray rock arm 48. A tray rock shaft 47 is engaged by a lower surface of the original tray 4. The tray rock shaft 47 is engaged by a tip end of the tray rock arm 48 and the other end of the tray rock arm 48 is engaged by a tray rock arm shaft 67 so that the tray rock arm 48 can be pivoted between positions shown in FIGS. 1 and 2 by the rotation of the tray rock arm shaft 67, thereby rocking the original tray 4 around the fulcrum 40.

An upper limit switch 51 serves to detect the fact that the original tray 4 reaches the upper limit position, and a lower limit switch 52 serves to detect the fact that the original tray 4 reaches the lower limit position. The rotation of the tray rock motor 107 is controlled by the detection of the upper and lower limit switches 51, 52 actuated by a projection 50 on the cam 49.

Next, the bundle-convey means on the original tray 4 will be explained.

Figure 15:
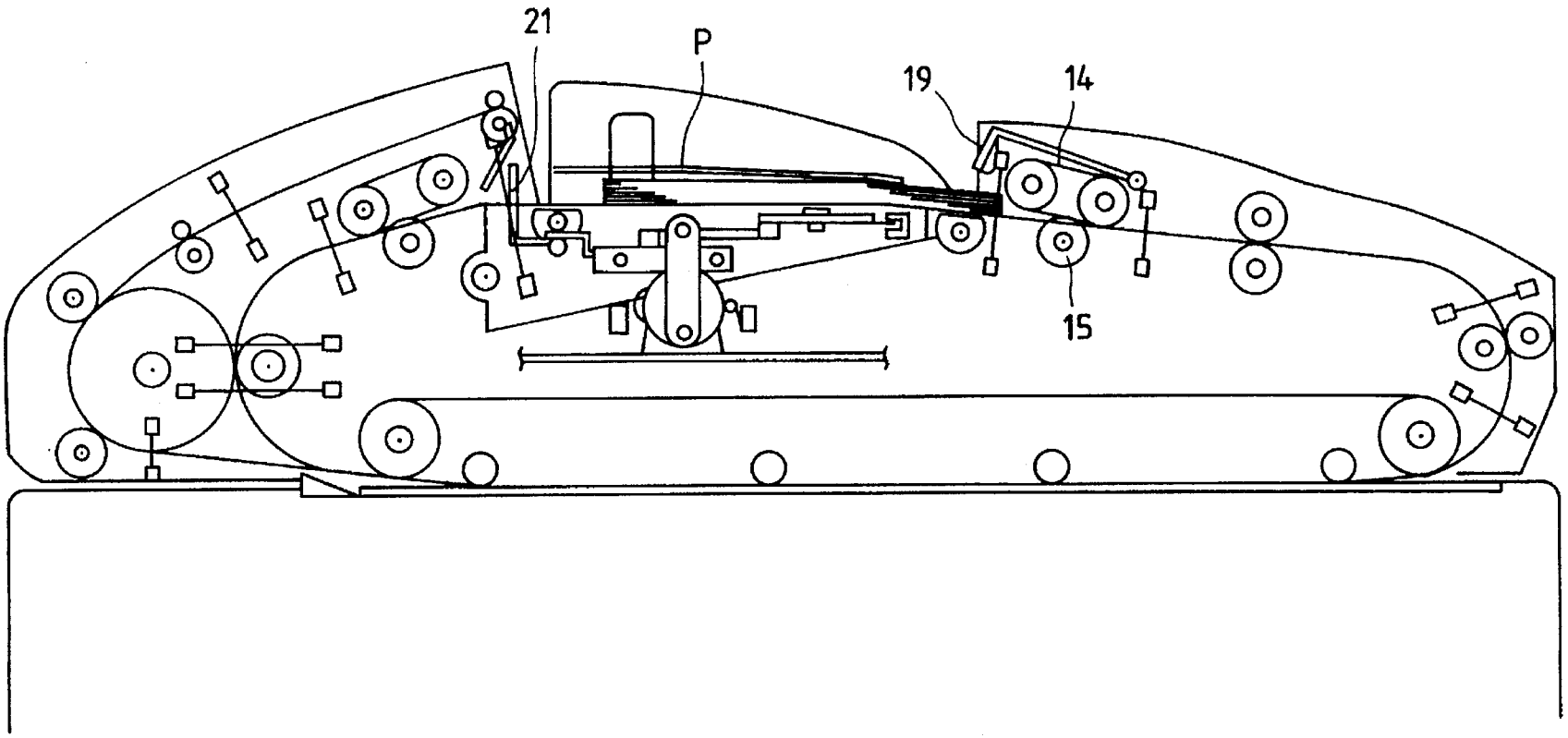
FIGS. 15 and 16 are sectional front views for explaining a sheet bundle conveying operation of the sheet supply apparatus.

A stopper slide motor 107 (FIG. 5) serves to shift the stopper 21 in a direction A in FIG. 2. As shown in FIG. 3, after the sheet original stack P is conveyed to the second separation portion 14, 15, the stopper 21 is returned to the original or initial position. Further, whenever the sheet original is discharged from the discharge rollers 11 onto the original tray 4, the stopper 21 urges the trailing end of the sheet original toward the second separation portion, thereby improving the registration of the sheet originals P on the original tray 4 in the original conveying direction (FIGS. 15 and 16).

Figure 17A:
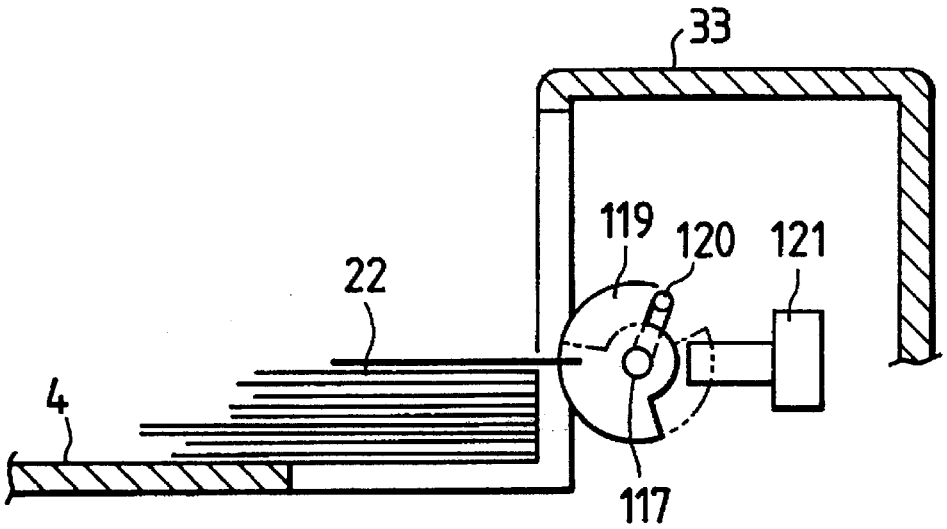
FIGS. 17A and 17B are longitudinal sectional front views of a recycle lever portion.
Figure 17B:
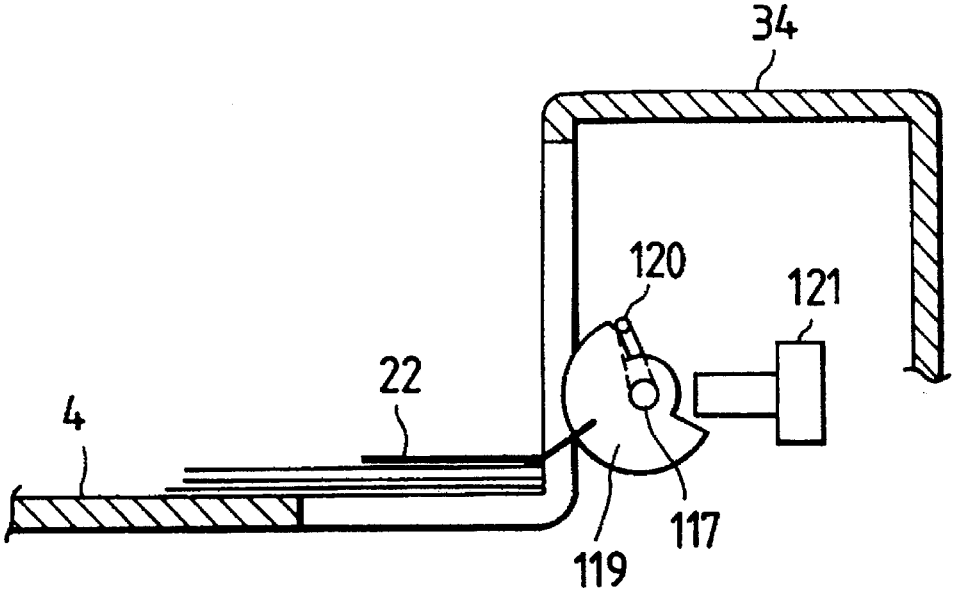

Next, the partition member of the original tray 4 will be explained with reference to FIGS. 17A and 17B. FIGS. 17A and 17B show the detailed construction of the partition member.

In FIGS. 17A and 17B, a partition flag 119 and a partition lever 120 are coaxially arranged on an output shaft 105 of a partition member motor 105 (FIG. 5). The flag 119 is rotatably supported for a free rotation, and the partition lever 120 is secured to the output shaft 117 and serves to rotatingly drive the partition flag 119. The partition flag 119 has a cut-out at a portion of its periphery, and a partition member 22 formed from flexible material such as a polyester film, leaf spring or the like is secured to the periphery of the flag 119 to rotate together with the partition flag around the output shaft 117.

Further, since the gravity center of the partition flag 119 is offset toward the partition member 22, when the flag is not driven by the partition lever 120, the partition member 22 is depended vertically by the weight of the flag. A partition sensor 121 serves to detect the partition flag 119, thereby determining the position of the partition flag 119.

In FIG. 17A, when the sheet originals P are fully stacked on the original tray 4, since a distance between the end face of the sheet original stack P and the root of the partition member 22 is short and the partition member 22 has strong resiliency, the partition member 22 is not deformed to maintain a flat condition on the sheet original stack P, as shown.

In FIG. 17B, when the number of sheet originals P stacked on the original tray 4 is decreased, as is the conventional case, if a rigid partition member is used, since a tip end of the partition member is contacted with the upper surface of the sheet original stack, the partition member will be floating from the upper surface of the sheet original stack at the end face of the stack. Thus, when the sheet original P is re-stacked on the partition member, the tip end of the sheet original is struck against the partition member, with the result that the sheet originals cannot be re-stacked on the original tray 4 stably. To the contrary, according to the present invention, as shown in FIG. 17B, since the partition member 22 is flexible, when the partition member 22 is driven by the partition lever 120, the partition member 22 follows the surface condition of the sheet original stack to be entirely contacted with the upper surface of the sheet original stack P, thereby keeping the flat condition along the upper surface of the stack even when the sheet originals are decreased.

Accordingly, regardless of the number of the sheet originals P on the original tray 4, the partition member 4 is always closely contacted with the upper surface of the sheet original stack P. As a result, when the sheet originals P are re-stacked on the partition member 22, since the sheet original does not strike against the partition member 22, the sheet originals P can stably be re-stacked without adversely affecting the re-supply of the sheet originals.

Figure 18:
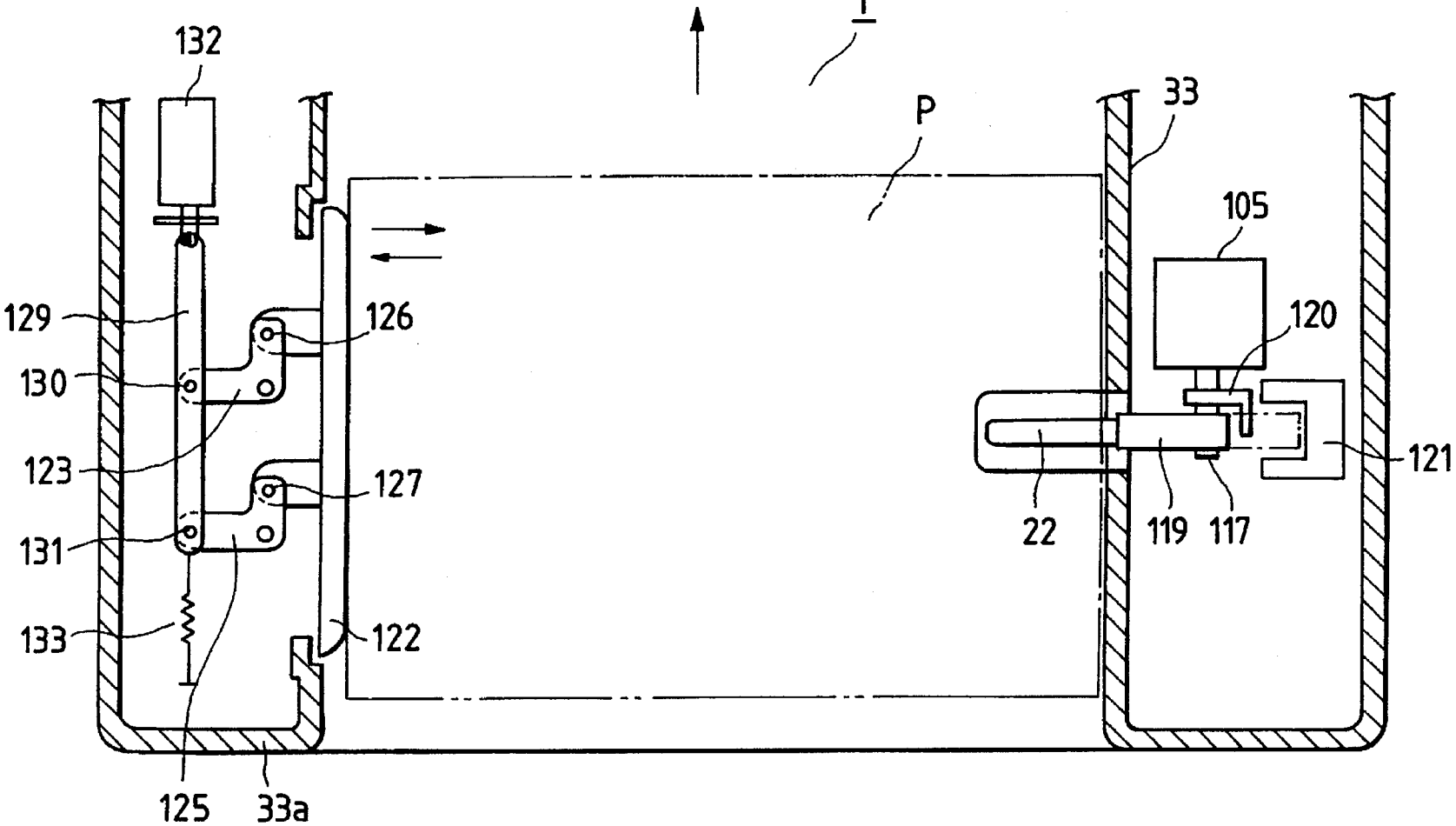
FIG. 18 is a plan view of the recycle lever portion and a jogging mechanism portion.

Next, the jogging mechanism will be explained with reference to FIG. 18 showing a top plan view of the original tray 4.

A jogging guide 122 forming a part of the widthwise direction regulating plate 33*a* is retractably supported by the widthwise direction regulating plate 33*a*. Two link pins 126, 127 are provided at a side of the jogging guide 122 opposite to a side facing the sheet original stack, which link pins 126, 127 are connected to jogging links 123, 125, respectively. The other ends of the jogging links 123, 125 are connected to a jogging lever 129 via lever pins 130, 131, respectively. Further, the jogging lever 129 is connected to a jogging solenoid 132.

With this arrangement, when the jogging solenoid 132 is turned ON, the jogging guide 122 is operated to urge the sheet original stack P against the original reference guide 33. On the other hand, when the jogging solenoid 132 is turned OFF, the jogging guide 122 is separated from the end face of the sheet original stack by a return spring 133. That is to say, whenever the sheet original P is re-stacked on the original tray 4, by repeating the ON/OFF operation of the jogging solenoid 132, the sheet original P is positively urged against the original reference guide 33, thereby enhancing the registration of the sheet originals P on the original tray 4.

Further, a slide volume (not shown) is connected to the widthwise direction regulating plate 33*a*, so that the size information of the sheet original in the widthwise direction can be obtained on the basis of the movement of the widthwise direction regulating plate 33*a*.

Further, as shown in FIG. 1, a sensor 68 for detecting the length of the sheet original is provided at the rear end of the original tray 4. For example, such a sheet length detection sensor 68 (for example, of reflection type) serves to judge whether the size of the sheet original is greater than the LTR size (216 mm) or not. When it is judged that the size of the sheet original is greater than the LTR size by the sheet length detection sensor 68, the sheet originals stacked on the original tray 4 are supplied by the first separation means 6, 38. On the other hand, when it is judged that the size of the sheet original is smaller than the LTR size by the sheet length detection sensor 68, then the size information of the sheet original in the widthwise direction is obtained by the slide volume shifted in synchronism with the widthwise direction regulating plate 33*a*, with the result that it is judged whether the size of the sheet original is A4 size or LTR size or not. If A4 size or LTR size, the original tray 4 is lowered to satisfy the requirements that the sheet originals can be supplied by the second separation means 14, 15. Further, it is judged whether the sheet originals should be supplied by the first separation means or the second separation means on the basis of the image formation mode inputted to the image forming apparatus. If the size of the sheet original is other than A4 size or LTR size, the sheet originals are supplied by the first separation means.

Incidentally, the above-mentioned reference regarding the size of the sheet original is merely an embodiment of the present invention, and, thus, the reference value of the sheet size can be selected optionally.

Second Embodiment

Figure 20:
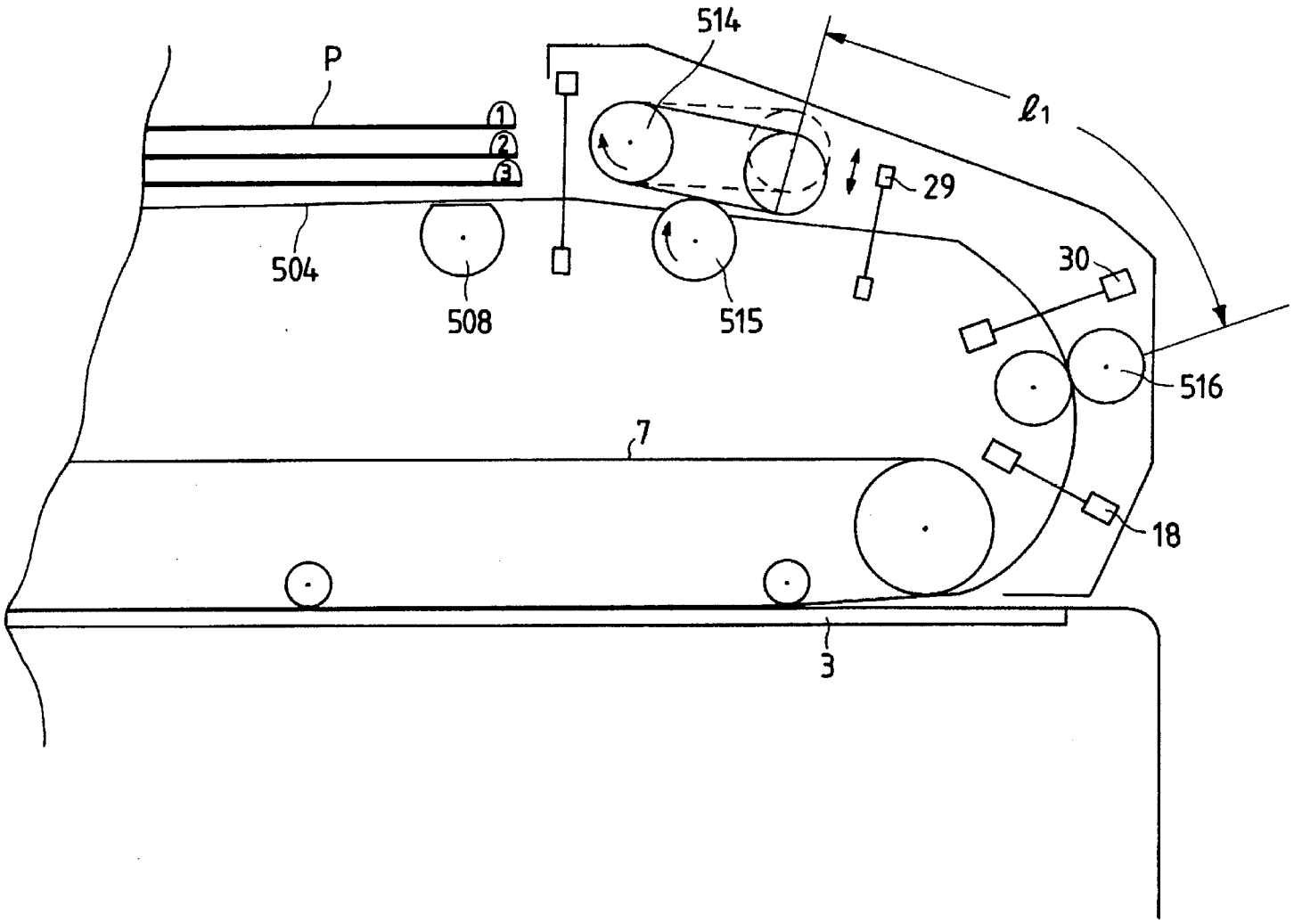
FIG. 20 is a longitudinal sectional front view of a portion of a sheet supply apparatus according to a second embodiment of the present invention.

FIG. 20 shows a second embodiment of the present invention. In this embodiment, since the left part of a sheet original supply apparatus is the same as that of the first embodiment, such left part is not shown and the explanation thereof will be omitted. In this second embodiment, a distance $l_1$ between a separation portion 514, 515 and a supply rollers 516 is shorter than 216 mm (LTR size). Sheet originals P on an original tray 504 are fed by a semi-circular roller 508 to the separation portion 514, 515, where the separation belt 514 and the separation roller 515 are rotated in directions shown by the arrows to separate the sheet originals one by one and to supply the separated sheet original. The supply rollers 516 also act as regist rollers for correcting the skew-feed of the sheet original P.

Figure 22:
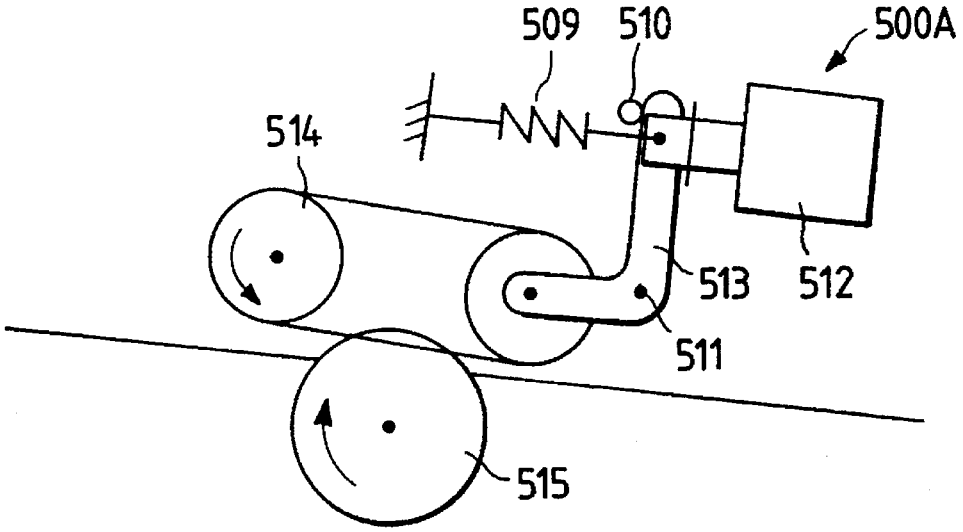
FIG. 22 is a front view of a drive portion according to the second embodiment.

Among a pair of belt rollers for driving the separation belt 514, a downstream roller can be lifted up to a position shown by the broken line to release the load of the separation means acting on the sheet original. As shown in FIG. 22, such load releasing mechanism (convey load avoiding means) 500A comprises a link 513 pivotable around a fulcrum 511 and connected to the downstream roller at its one end, a tension spring for pulling the other end of the link 513, and a solenoid 512 connected to the other end of the link 513 so that the downstream roller can be lifted and lowered by the ON/OFF control of the solenoid 512. The link 513 is normally abutted against a stopper 510 so that the downstream roller is fixed at a predetermined position, thereby ensuring the constant gap amount between the separation belt 514 and the separation roller 515. After the regist correction of the sheet original is finished at the supply rollers 516 and when the sheet original starts to be conveyed by the supply rollers 516, at the same time or immediately before the start of the sheet original, the downstream roller of the separation belt 514 is retarded upwardly, so that the trailing end of the sheet original remaining in the separation portion 514, 515 is not subjected to the load from the separation portion. Consequently, the sheet original can be conveyed to the image reading portion only by the supply rollers 516.

In this way, it is possible to avoid the load of the separation portion by separating the belt roller and the separation roller, with the same technical effect. Incidentally, in this second embodiment, the relay rollers 16 used in the first embodiment can be omitted, thus making the sheet supply apparatus small-sized.

Third Embodiment

Figure 21:
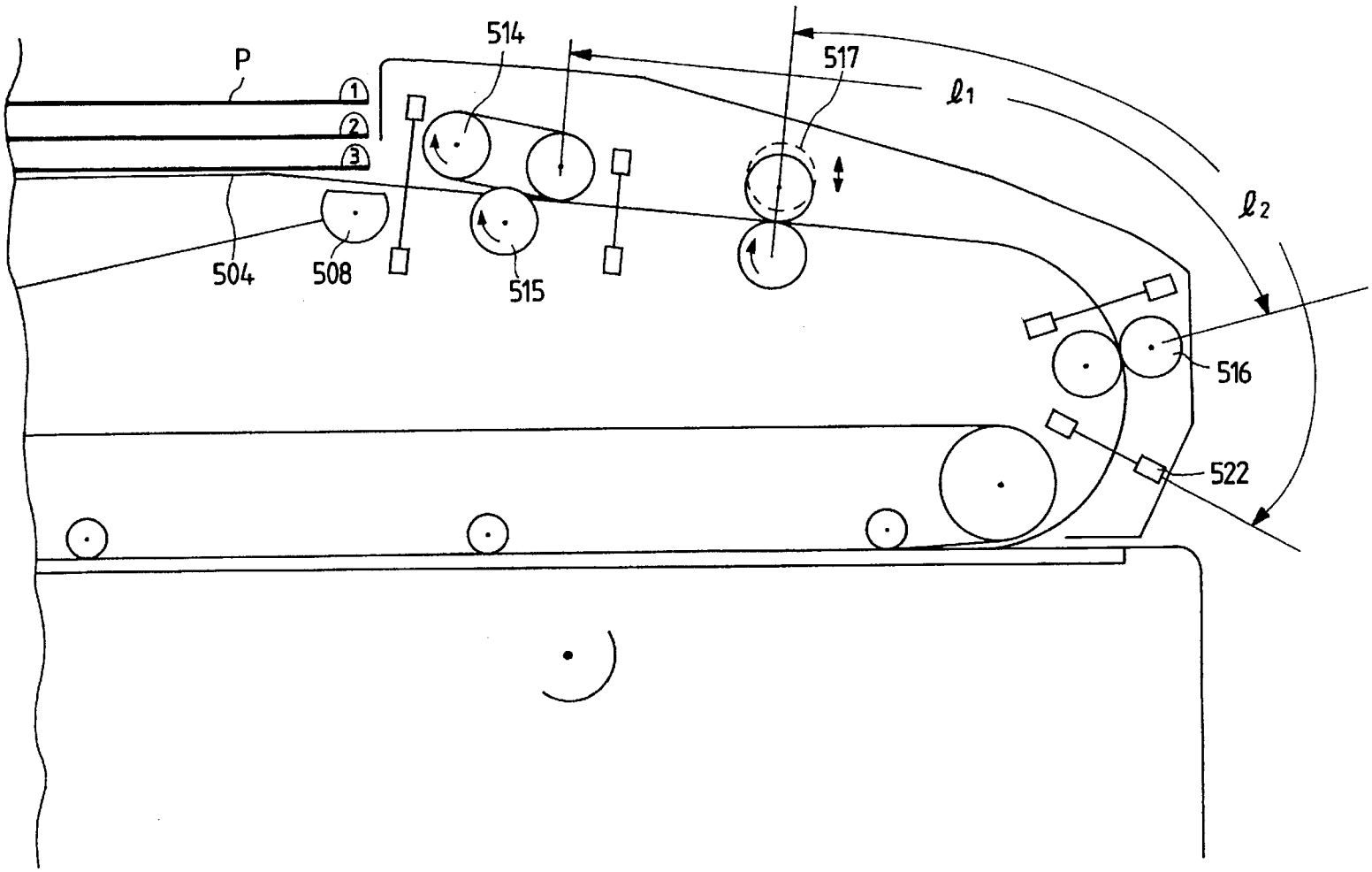
FIG. 21 is a longitudinal sectional front view of a portion of a sheet supply apparatus according to a third embodiment of the present invention.

FIG. 21 shows a third embodiment of the present invention. Also in this embodiment, since the left part of a sheet original supply apparatus is the same as that of the first embodiment, such left part is not shown and the explanation thereof will be omitted.

In this third embodiment, as in the second embodiment, sheet originals P on the original tray 504 are fed by the semi-circular roller 508 to the separation portion 514, 515, where the separation belt 514 and the separation roller 515 are rotated in directions shown by the arrows to separate the sheet originals one by one and to supply the separated sheet original. The supply rollers 516 also act as regist rollers for correcting the skew-feed of the sheet original P.

Figure 23:
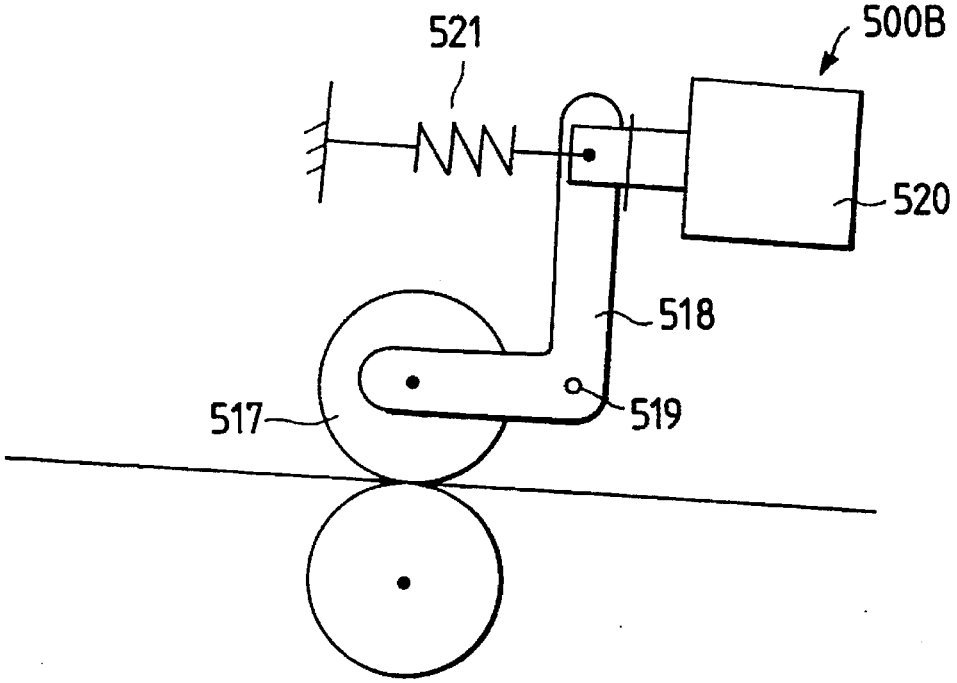
FIG. 23 is a front view of a drive portion according to the third embodiment.

As shown in FIG. 23, a driven roller of a pair of relay rollers 517 is shiftable up to an upper position shown by the broken line by a load release mechanism (convey load avoiding means) 500B comprising a link 518 pivotable around a fulcrum 519 and connected to the driven roller at its one end, a tension spring 521 for pulling the other end of the link 518, and a solenoid 520 connected to the other end of the link 513. Normally, when the solenoid 520 is turned OFF, a nip pressure of the paired relay rollers is ensured by the spring 521.

After the regist correction of the sheet original is finished, the sheet original starts to be conveyed by the supply rollers 516. Immediately before the tip end of the sheet original reaches a sensor 522, the driven roller of the pair of relay rollers 517 is shifted to the position shown by the broken line, thereby separating the relay rollers from each other.

Incidentally, although a distance $l_1$ between the separation portion 514, 515 and the supply rollers 516 is greater than 216 mm (LTR size), a distance $l_2$ between the relay rollers 517 and the image tip end sensor 522 may be smaller than 216 mm (LTR size) since the relay rollers 517 can be separated from each other as mentioned above.

In this way, by separating the relay rollers from each other, as in the first embodiment, it is possible to prevent the load of the relay rollers, thereby preventing the occurrence of slip in the sheet conveyance after the sheet is detected by the sensor 522.

As an alteration of the third embodiment, in FIG. 21, the distance $l_1$ between the separation portion 514, 515 and the supply rollers 516 may be smaller than 216 mm (LTR size). In this case, a spring force of the tension spring 521 (FIG. 23) is selected to generate the (strong) nip pressure of the paired relay rollers 517 sufficient to avoid the influence of the load of the separation portion 514, 515 upon the trailing end of the sheet original. That is to say, the sheet original is pulled by the relay rollers with a conveying force greater than a force pulling the sheet original from the separation portion.

In this way, by selecting the nip pressure of the paired relay rollers 517 to avoid the influence of the load of the separation portion, the sheet feeding amount at the regist rollers (supply rollers) is not influenced upon the load of the separation portion. Further, since the load of the relay rollers 517 can be avoided by separating the relay rollers from each other when the sheet original leaves the relay rollers, the distance $l_2$ between the relay rollers 517 and the image tip end sensor 522 can be smaller than 216 mm (LTR size), thereby making the sheet original supply apparatus compact and achieving the same technical effect as the aforementioned embodiment.

Fourth Embodiment

Figure 24:
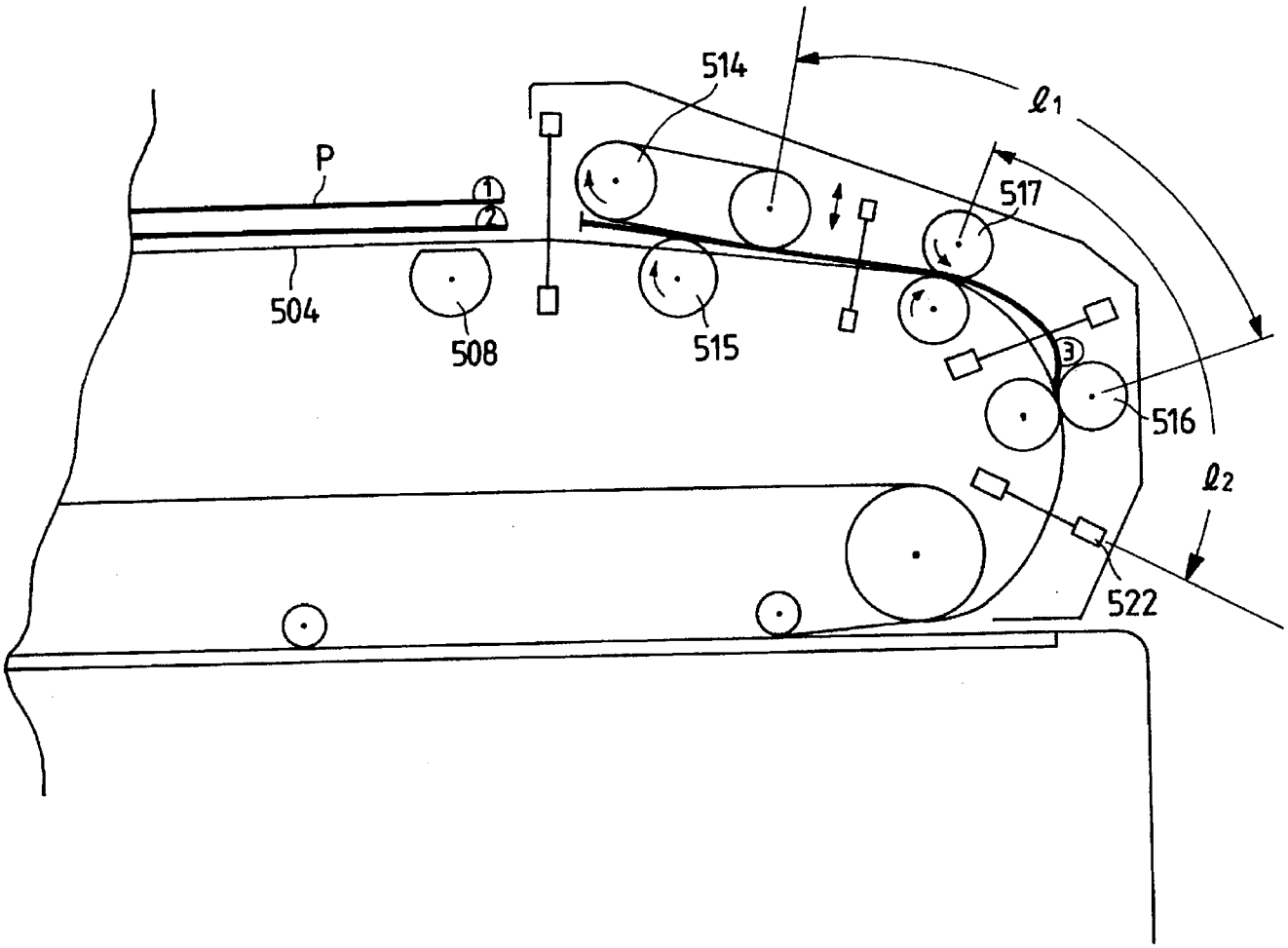
FIG. 24 is a longitudinal sectional front view of a portion of a sheet supply apparatus according to a fourth embodiment of the present invention.

Next, a fourth embodiment of the present invention will be explained with reference to FIG. 24.

A distance $l_1$ between a separation portion 514, 515 and supply rollers 516 for effecting the regist correction and a distance $l_2$ between relay rollers 517 and an image tip end sensor 522 are selected to be smaller than 216 mm (LTR size). FIG. 24 shows a condition that the sheet original separated by the separation portion 514, 515 and conveyed by the relay rollers 517 is abutted against the supply rollers (regist correction means) 516 to form a loop in the sheet original. An amount of the loop can be adjusted by controlling the sheet feeding amount of the relay rollers 517. When a predetermined amount of the loop is formed, the relay rollers 517 and the supply rollers 516 are rotated at the same speed, so that the sheet original is conveyed to the reading portion while maintaining the loop.

By conveying the sheet original while maintaining the loop in this way, even if the slip is generated between the relay rollers 517 and the sheet original, since such slip is absorbed by the loop in the sheet original, the sheet original can be conveyed by the supply rollers 516 without no slip, thereby preventing the sheet original from becoming out-of-registration. Further, the apparatus can be made small-sized.

Figure 19:
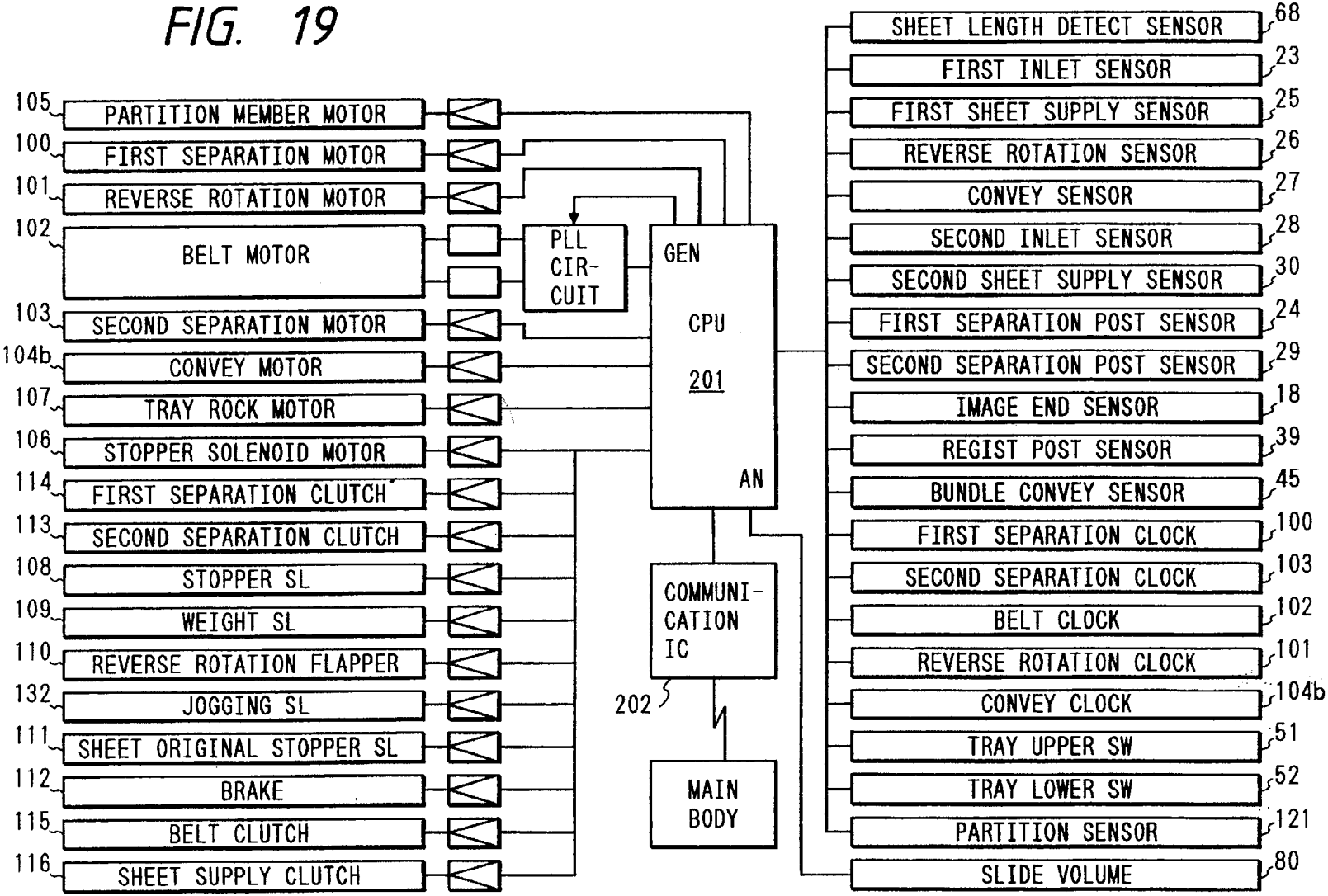
FIG. 19 is a block diagram of a control portion of the sheet supply apparatus.

FIG. 19 is a block diagram showing circuitry of a control device of the circulating original supply apparatus according to the present invention.

In FIG. 19, the control circuit comprises a one-chip microcomputer (CPU) 201. Signals from various sensors are inputted to input ports of the microcomputer 201. Further, the slide volume for detecting the width of the sheet original is connected to an A/D conversion terminal of the microcomputer 210 so that the value of the slide volume can be detected continuously with 255 steps.

Further, various loads are connected to output ports of the microcomputer 201 via drivers. Particularly, the belt motor 112 is connected to the output port of CPU 201 via conventional PLL circuit and a reversible driver. A rectangular wave signal having any frequency is inputted from a rectangular wave output terminal of the microcomputer 201 to the PLL circuit, so that the speed of the belt motor 112 and accordingly the peripheral speed of the wide belt 7 can be changed by changing the frequency of the signal.

Further, the communication of the control data is effected between the control device and the copying machine through a communication IC 202. The received data may be, for example, the reading-through speed data (v) from the copying machine, original convey mode (such as single-face mode, both-face mode or reading-through mode) data, original supply trigger, original exchange trigger, original discharge trigger and the like. On the other hand, the sending date may be, for example, the original supply/original exchange/original discharge operation completion signals, detected original size data, final original signal informing of the division of the original bundle, image tip end signal in the reading-through mode and the like.

Other than above, since the control is effected in a well-known manner, explanation thereof will be omitted.

Figure 25:
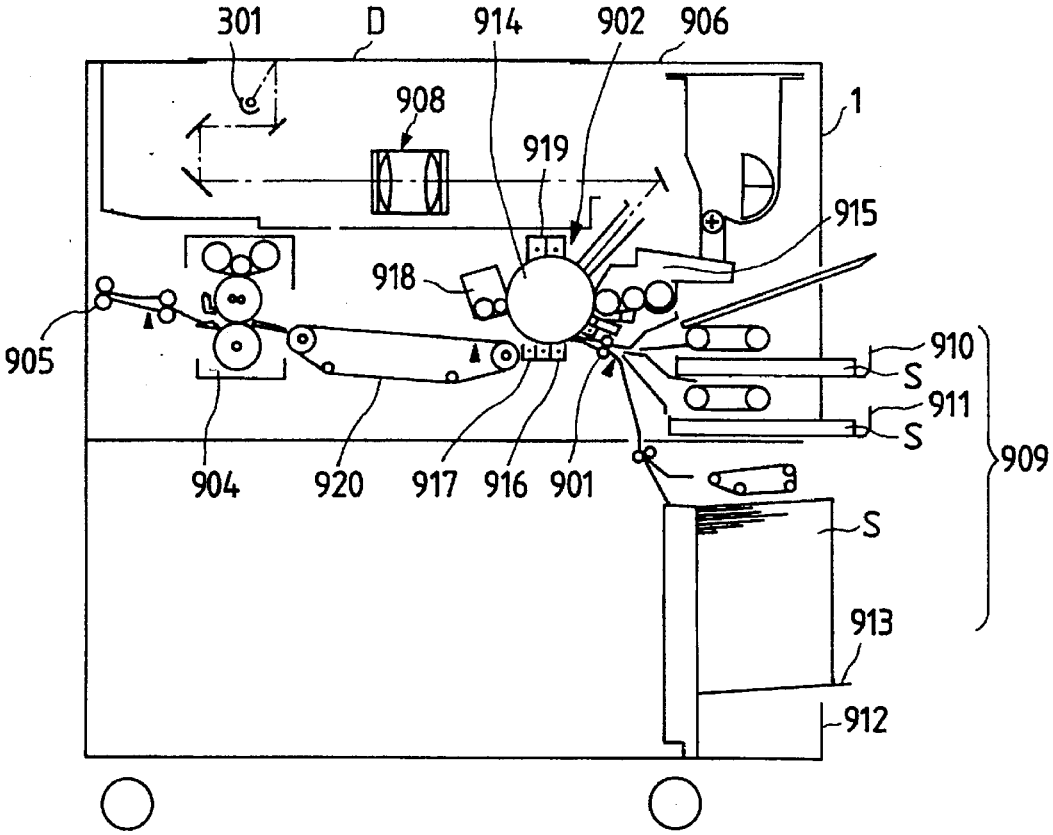
FIG. 25 is a longitudinal sectional front view showing an example of an image forming apparatus to which the sheet supply apparatus of the present invention can be applied.
Figure 26:
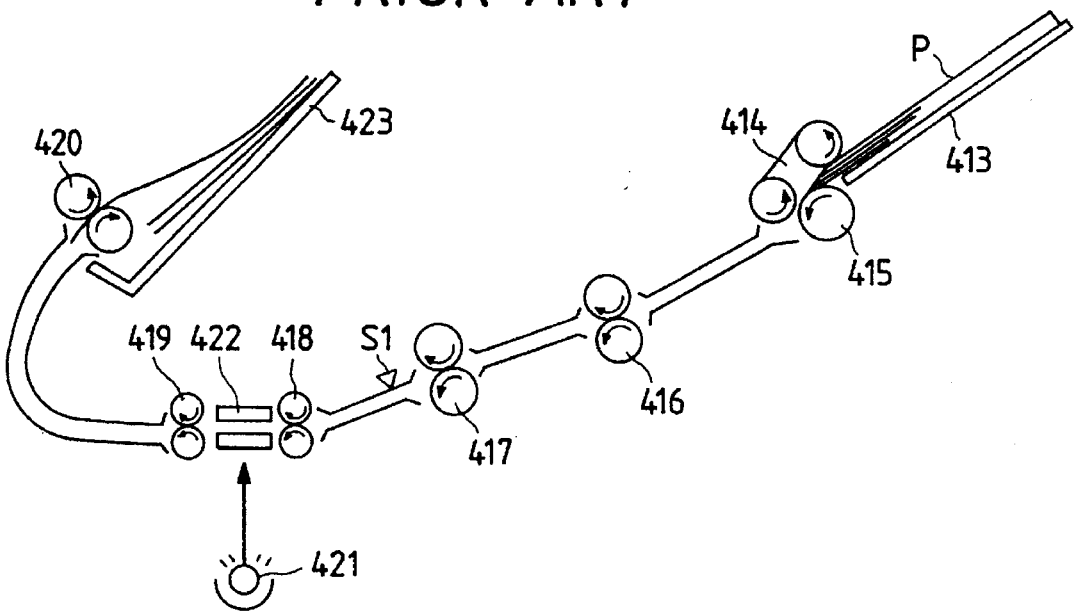
FIG. 26 PRIOR ART
FIG. 26 is a front view for explaining a conventional technique.

Lastly, FIG. 25 shows an example of an image forming apparatus (copying machine) to which the present invention can be applied.

An original resting platen glass 3, a light source 301, a lens system 908, a sheet supply portion 909, and an image forming portion 902 are arranged within a body 1 of the image forming apparatus. The sheet supply portion 909 includes cassettes 910, 911 removable with respect to the body 1 of the apparatus and adapted to contain sheets, and a deck 913 disposed on a pedestal 912. The image forming portion 902 includes a cylindrical photosensitive drum (image forming portion) 914 around which a developing device 915, a transfer charger 916, a separation charger 917, a cleaner 918 and a first charger 919 are arranged. A convey device 920, a fixing device 904 and discharge rollers 905 are arranged at a downstream side of the image forming portion 902.

An operation of the image forming apparatus will now be explained.

When a sheet supply signal is emitted from a control device (not shown) of the image forming apparatus 1, a sheet S is supplied from a cassette 910 or 911 or the deck 913. On the other hand, light emitted from the light source 301 and reflected by an original D rested on the platen glass 3 is sent to the photosensitive drum 914 through the lens system 908. The photosensitive drum 914 was previously charged by the first charger 919. Accordingly, when the light is illuminated on the photosensitive drum, an electrostatic latent image is formed on the drum. Then, the latent image is developed by the developing device 915 as a toner image.

The skew-feed of the sheet S supplied from the sheet supply portion 909 is corrected by a pair of regist rollers 901, and the sheet is then sent to the image forming portion 902 at a predetermining timing. In the image forming portion 902, the toner image on the photosensitive drum 914 is transferred onto the sheet S by the transfer charger 916, and then the sheet to which the toner image was transferred is separated from the photosensitive drum 914 by the separation charger 917 by applying the charging polarity opposite to that of the transfer charger 917 to the sheet. The separated sheet S is then sent, by the convey device 912, to the fixing device 904, where the non-fixed toner image is permanently fixed to the sheet S. Then, the sheet S is discharged out of the image forming apparatus 1 by the discharge rollers 905.

In this way, the image is formed on the sheet S supplied from the sheet supply portion 909 and then the sheet is discharged.

Although the optical system or light source (reading means) 301 is positioned in the position shown in FIG. 25 (FIG. 1) in the reading-stationary mode, when the reading-through mode is selected, the light source is shifted to the right up to the reading position shown in FIG. 4.

In FIG. 25, when the lens system 908, the light source 301 and the upper sheet original supply apparatus are combined, an automatic sheet original reading apparatus is obtained.

What is claimed is:

1. An original supply apparatus for supplying originals to a reading means, said reading means for reading an original during feeding at a reading position on a glass platen, comprising:

rotary convey belt means for conveying the original on the glass platen through the reading position; and a pair of rotary supply means arranged directly upstream of said rotary convey belt means for supplying the original to said rotary convey belt means, wherein the glass platen has a reading start position located midway of the glass platen in the original feeding direction so that when a leading end of the original reaches the reading start position, a trailing end of the original is located upstream of, and is not restrained by, said rotary convey belt means, wherein said pair of rotary supply means is disposed at a location wherein a distance between the reading start position and said pair of rotary supply means is smaller than a length of the original, and wherein after the original starts to be conveyed by said rotary convey belt means and before the original is read at said reading start position, restraint exerted by said pair of rotary supply means on the original is released by separating said pair of rotary supply means from each other.

2. An original supply apparatus according to claim 1, wherein a sensor is arranged between said pair of rotary supply means and said rotary convey belt means, and the original is stopped temporarily so that a tip end of the sheet original is positioned immediately in front of said sensor, said sensor serving to determine a reading start timing for the original.

3. An original supply apparatus according to claim 2, wherein relay supply means is arranged upstream of said pair of rotary supply means, a distance between said relay supply means and said sensor being selected to be greater than a length of an available maximum original.

4. An original supply apparatus according to claim 3, wherein separation supply means is arranged upstream of said relay supply means, a distance between said separation supply means and said pair of rotary supply means being selected to be greater than a length of an available maximum original.

5. An original supply apparatus according to claim 1, wherein a sensor is arranged between said pair of rotary supply means and said rotary convey belt means, and a relay supply means is arranged at an upstream side of said pair of rotary supply means, a distance between said relay supply means and said sensor being selected to be greater than a length of an available maximum original.

6. An original supply apparatus according to claim 5, wherein separation supply means is arranged at an upstream side of said relay supply means, a distance between said separation supply means and said pair of rotary supply means being selected to be greater than a length of an available maximum original.

7. An original supply apparatus according to claim 1, wherein said pair of rotary supply means and said rotary convey belt means are rotary members rotated at the same speed.

8. An original supply apparatus according to claim 1, wherein the original is positioned on said platen, so that the original can be read by shifting said optical system.

9. An original supply apparatus according to claim 1, wherein separation supply means is arranged upstream of said pair of rotary supply means, and wherein said separation supply means can be separated from the original and a distance between said separation supply means and said pair of rotary supply means is selected to be smaller than a length of an available maximum original.

10. An original supply apparatus according to claim 1, wherein a guide arranged between said pair of rotary supply means and said rotary convey belt means for guiding the original is curved.

11. An original supply apparatus according to claim 1, wherein the original is fed by only the rotary convey belt means during reading thereof.

12. A recording apparatus comprising:

reading means for reading an image of an original during feeding at a reading position on a glass platen;

rotary convey belt means for conveying the original on the glass platen through the reading position;

a pair of rotary supply means arranged upstream of said rotary convey belt means for supplying the original to said rotary convey belt means, and recording means for recording the read image on a recording medium, wherein the glass platen has a reading start position located midway on the glass platen in the original feeding direction so that when a leading end of the original reaches the reading start position, a trailing end of the original is located upstream of, and not restrained by, said rotary convey belt means, wherein said pair of rotary supply means is disposed at a location where a distance between the reading start position and said pair of rotary supply means is smaller than a length of the original, and wherein after the original starts to be conveyed by said rotary convey belt means and before the original is read at said reading start position, restraint exerted by said pair of rotary supply means on the original is released by separating said pair of rotary supply means from each other.

13. A reading apparatus comprising:

reading means for reading an image of an original during feeding at a reading position on a glass platen;

rotary convey belt means for conveying the original on the glass platen through the reading position; and a pair of rotary supply means arranged upstream of said rotary convey belt means for supplying the original to said rotary convey belt means, wherein the glass platen has a reading start position located midway on the glass platen in the original feeding direction so that when a leading end of the original reaches the reading start position, a trailing end of the original is located upstream of, and not restrained by, said rotary convey belt means, wherein said pair of rotary supply means is disposed at a location where a distance between the reading start position and said pair of rotary supply means is smaller than a length of the original, and wherein after the original starts to be conveyed by said rotary convey belt means and before the original is read at said reading start position, restraint exerted by said pair of rotary supply means on the original is released by separating said pair of rotary supply means from each other.

* * * * *

UNITED STATES PATENT AND TRADEMARK OFFICE

CERTIFICATE OF CORRECTION

PATENT NO. : 5,645,273
DATED : July 8, 1997
INVENTOR(S) : Tomohito NAKAGAWA et al.

It is certified that error appears in the above-identified patent and that said Letters Patent is hereby corrected as shown below:

Column 2:

Line 50, "device" should read --means--;
Line 51, "means" should read --device--.

Column 4:

Line 42, "5" (second occurrence) should be deleted.
Line 52, "downstreamly" should read "downstream--.

Column 9:

Line 47, "clutch 16" should read --clutch 116--.

Column 10:

Line 5, "downstreamly." should read --downstream.--.

UNITED STATES PATENT AND TRADEMARK OFFICE

CERTIFICATE OF CORRECTION

PATENT NO. : 5,645,273

DATED : July 8, 1997

INVENTOR(S) : Tomohito Nakagawa, et al

It is certified that error appears in the above-identified patent and that said Letters Patent is hereby corrected as shown below:

Column 14:

Line 35, "no" should be deleted.

Signed and Sealed this

Thirty-first Day of March, 1998

*Attest:*

Bruce Lehman

BRUCE LEHMAN

*Attesting Officer*

*Commissioner of Patents and Trademarks*